US006466176B1

(12) United States Patent
Maoz et al.

(10) Patent No.: US 6,466,176 B1
(45) Date of Patent: Oct. 15, 2002

(54) INTERNAL ANTENNAS FOR MOBILE COMMUNICATION DEVICES

(75) Inventors: Joseph Maoz; Michael Kadichevitz, both of Tel Aviv (IL)

(73) Assignee: In4tel Ltd., Herzliya Pituach (IL)

( * ) Notice: Subject to any disclaimer, the term of this patent is extended or adjusted under 35 U.S.C. 154(b) by 0 days.

(21) Appl. No.: 09/649,023

(22) Filed: Aug. 28, 2000

Related U.S. Application Data

(60) Provisional application No. 60/217,021, filed on Jul. 11, 2000.

(51) Int. Cl.[7] ..... H01A 13/10
(52) U.S. Cl. ..... 343/767; 343/702
(58) Field of Search ..... 343/700 MS, 702, 343/767, 770, 829, 846; H01Q 1/24, 13/10

(56) References Cited

U.S. PATENT DOCUMENTS

| | | | | |
|---|---|---|---|---|
| 5,068,670 A | | 11/1991 | Maoz | |
| 5,929,813 A | | 7/1999 | Eggleston | |
| 5,945,813 A | | 8/1999 | Johnson | |
| 5,966,101 A | | 10/1999 | Haub et al. | |
| 6,002,367 A | | 12/1999 | Engblom et al. | |
| 6,025,802 A | | 2/2000 | Eggleston et al. | |
| 6,031,503 A | * | 2/2000 | Preiss et al. | 343/770 |
| 6,043,786 A | | 3/2000 | Vannatta et al. | |
| 6,054,954 A | * | 4/2000 | Eggleston et al. | 343/700 MS |
| 6,072,434 A | * | 6/2000 | Papatheodorou | 343/700 MS |
| 6,133,879 A | | 10/2000 | Grangeat et al. | |
| 6,133,883 A | * | 10/2000 | Munson et al. | 343/700 MS |
| 6,255,958 B1 | * | 5/2001 | Amano et al. | 343/767 |
| 6,252,552 B1 | * | 6/2001 | Tarvas et al. | 343/700 MS |

* cited by examiner

*Primary Examiner*—T Phan
(74) *Attorney, Agent, or Firm*—G. E. Ehrlich Ltd.

(57) ABSTRACT

A multi-band microwave antenna which is resonant and radiant at a high frequency band and at one or more lower frequency bands includes an electrically-conductive ground plane on one face of a dielectric substrate; an electrically conductive strip line on the opposite face of the dielectric substrate; a curved slot formed in the ground plane having a feed side electromagnetically coupled to the feed end of the strip line, and a load side electromagnetically coupled to the load end of the strip line, such that the slot is resonant and radiant at the high frequency band; and a further electrical conductor electrically connected to the ground plane to serve as a continuation thereof at the load side of the slot and electromagnetically coupled to the slot at the lower frequency bands such as to cause the slot to be resonant and radiant also at the lower frequency band or bands.

44 Claims, 24 Drawing Sheets

1200

Rigid PCB 206a
206a'
206b'
206b
108c
108a
108b
105
105'

103
104
104'
108c
108a
108b 103
206a
206a'
206b'
206b
104
104'
108c
108a
108b
105
105'
108

1300

Rigid PCB
Fig. 18b
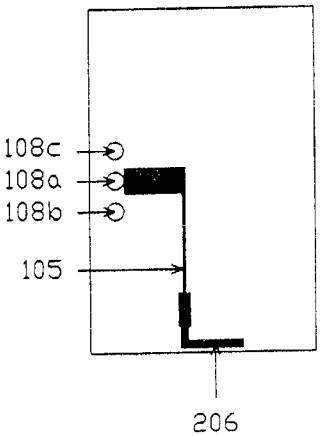
Fig. 18a
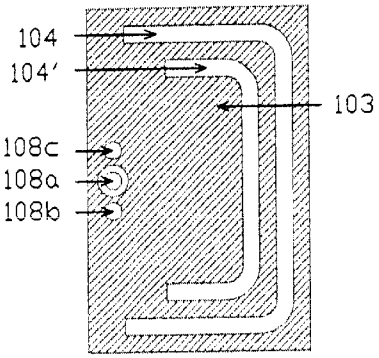
Fig. 18
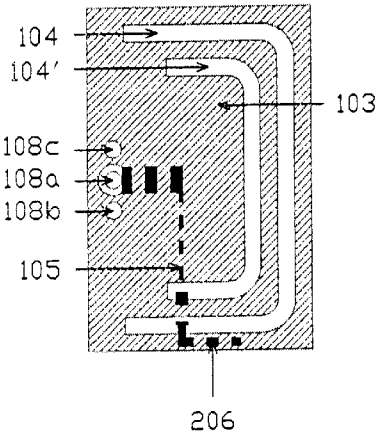
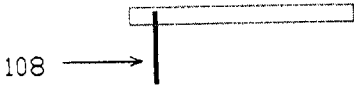
Fig. 18c
1400

Rigid PCB
1500
104
107a
106a
104c
1509c
104a
103
105b
108c
108a
108b
105a
105c
105
104b
1509a
111a
111b
110
1509
1509b
107b
106b
101
102

101
102

101
102
112

102
101
112
108

INTERNAL ANTENNAS FOR MOBILE COMMUNICATION DEVICES

RELATED APPLICATION

This application is related to Provisional Application 60/217,021 filed Jul. 11, 2000 and claims the priority data of that application.

FIELD OF THE INVENTION

The present invention relates generally to antennas and, more particularly, to small and high efficiency antennas for mobile and handset communication devices.

BACKGROUND OF THE INVENTION

Mobile communication devices are becoming smaller as the technology is developed. For an antenna to operate properly, it should usually be about half a wavelength in size, except for monopole-like antennas (which normally operate above a ground plane), where a quarter wavelength is required. For advanced mobile communication devices, e.g., cellular handset units, such dimension are impractical since the overall handset dimension is smaller than half a wavelength of the appropriate frequency.

Using small antennas reduces their efficiency, and hence requires higher power to be supplied in order to operate the device. Higher power causes shorter battery cycles between charging and increases the radiation into the user's head/body. The level of power radiated into the human head is most significant, and serious limitations and specifications are prescribed in order to protect the users.

Operation of such devices adjacent to a human body also changes the field and/or current distribution along the antenna, and hence changes its radiation pattern, as well as the radiation efficiency. Practically speaking, the reduction in efficiency may be even in the range of 10–20 dB or more. The result is a requirement for higher power to operate the device with the consequent disadvantages described above. The use of external whip antennas, such the "STUBBY" or retractable antennas, is also inconvenient, as the antennas are often "caught up" inside the pocket. They also detract from the aesthetic appearance of the mobile communication device and most important—the radiation pattern is quasi-omni, so no enhancement is achieved in radiation at the user's head/body.

Internal antennas supplied by several companies are relatively inefficient as compared to external antennas. Furthermore, these known internal antennas generally do not decrease the radiation into the user's head/body, and in many cases even increases such radiation. The antenna gain is also generally poor (especially while used adjacent to the head/body), and the SAR (Specific Absorption Ratio) results are generally high.

Another problem in the known internal antenna is the narrow bandwidth of operation. In addition to the narrow bandwidth where the input impedance is matched the radiation efficiency is even further reduced. The latter is considered an even more difficult problem in cases where dual frequency bands or triple-band operations of the mobile communication devices are required, such as cellular GSM 900/1800, 900/1900, 900/1800/1900 MHz, etc.

Internal antennas for mobile communication devices are known that utilize a resonant radiation element as the main radiator. In particular, printed antennas, e.g. patches and slots, are very convenient to use because of their ease of manufacture, their low profile, and their low production cost. If such printed elements could be used in mobile communication devices with respect to efficiency, gain, impedance matching and reproducibility, it would be the best choice. Unfortunately, such elements, because of the small size of the mobile communication device, will show very low efficiency and hence low gain, and it will be difficult to match their impedance to that of the mobile communication device.

Generally, slots excited by a feed line (e.g., by microstrip or stripline structures) or by a coax cable, are usually narrow band. In order to achieve matching of the slot even over a narrow band, the excitation of the slot is generally made off-center, to reduce the input impedance of the slot, which is naturally very high. U.S. Pat. No. 5,068,670 by one of the inventors in this application and hereby incorporated by reference describes a broadband slot antenna achieved by adding matching networks at both sides of the slot. In the preferred embodiment, the feed lines are located off-center of the slot.

The direction of maximum radiation of an off-center excited slot is changed with frequency due to the asymmetrical electric and magnetic field distributions excited along the slot. While narrow bandwidth slots are not significantly affected by this phenomenon, broadband slots are indeed affected. The best solution is to excite the slot symmetrically by dual feed and load lines, which may be split from a single excitation feed. Each of the strip arms has a dual matching network in order to widen the bandwidth of the antenna. The length and width of each arm may be equal in order to achieve full symmetrical structure, but may also differ in order to maximize the bandwidth. If the arms art not identical, there will be some squint with frequency.

The slot may be a non-resonant one, by making it open at both ends ("open-ended"), or a resonant one, by making it closed at both ends ("short-ended"). The reaction efficiency depends on the field distribution—amplitude and phase, along the slot. The fields in short-ended slots mush vanish at both ends of the slot; and since they are continuous, their value at any point along the slots cannot reach the required level as with shorter slots. Therefore, short-ended slots are relatively large, usually in the range of half wavelength at the operation frequency.

The fields in open-ended slots may have finite value at their ends and should not vanish. It follows that a reasonable value of the field can be reached even for relatively short-length slots. The excitation point may then be optimized for single or dual feeds. It should be taken into consideration that radiation pattern will be different from the usual one. Further, the load type of the strip for open-ended slots would preferably be of the form of a short circuit, to eliminate a floating ground at the far end of the slot. As a result, this configuration is more complex to match by means of the relative part of the slot impedance. Furthermore, a floating ground would decrease the antennas efficiency.

EP 0924797 describes a slot antenna configuration in which the slot is curved along two axes, and is excited at its center point by a coax cable. There are a number of disadvantages of such configuration as suggested by this patent. Thus, the matching of such a slot is very difficult due to the centered excitation point (as described above and in U.S. Pat. No. 5,068,670). In addition, the part of the slot which contributes to the radiation in the desired direction is very small while, due to the folded arms of the slot which are parallel, the fields are opposite in polarization and hence cancel the radiation at most desired directions. Further, the excitation is complex and costly to implement. Finally, slots which are open-ended at one end are less efficient as compared to short-ended slots, and cause radiation in undesired directions. The radiation pattern will be asymmetrical due to the radiation from the open end of the slot, since the fields do not vanish, as above-mentioned.

U.S. Pat. Nos. 5,929,813 and 6,025,802 describe similar antennas. Such antennas are actually loop antennas where a "wired slot" generates a loop antenna. There are a number of disadvantages of such configuration as suggested by this patent. Thus, "wired slot" is open at the connecting points, is cut along the edge of the antenna and is also folded on the metal sheet, hence it causes radiation in undesired directions and with opposed (horizontal) polarization. The "wired slot" is excited by the antenna connector very close to the antenna (and telephone) edge; hence, radiation at the user's head is not reduced. Actually, because of the phone's PCB, which significantly contributes to the radiation at CDMA/TDMA/GSM frequencies (800 and 900 MHz), it would appear that the radiation at the user's head is even increased.

Further, in the embodiment of a dual frequency operation according to these referenced patents, the radiation pattern in the higher band has nulls, or at least significant reduction at certain angles and is far from being omni-directional in the azimuth plane. In this configuration each "wired slot" affects the operation of the other band when it is not supposed to influence the loop produced by this configuration is parallel to the user's head in "talk position" (e.g. a position where the user holds the mobile communication device adjacent to his head), and hence the fields' distributions are significantly changed by the human body.

As a result, the performance of the antenna is reduced, high transmitted power level would be required, and the sensitivity of reception would be less than required.

U.S. Pat. No. 6,002,367 describes a slot antenna excited by a feed line, similar to the structure described in U.S. Pat. No. 5,068,670. The slot is excited at its center point, and is very small as compared to the wavelength at the operational frequency; hence it does not radiate efficiently. The patch (or patches) added above the slot is (are) excited by the feed line; the load line (described in several embodiments) and the grounding of the patch tune the patch. This antenna mechanism is similar to that of the well-known Planar Inverted "F" Antenna (PIFA), where the grounding of the element tunes the antenna, except for the signal feeding, which is made by a feed line rather than a probe (PIFA). The performance of the antenna is average and less. It is complicated to build and relatively expensive, and no real reduction in the radiation at the user's head/body is achieved. In addition, the structure's height is large even in the simplest embodiment of a single patch. For modern mobile communication devices, which are very compact in size, such dimensions are impractical. Other antenna constructions are described in WO 99/13528, and WO 99/36988 (U.S. Pat. No. 5,945,954) but such antennas also suffer from one or more of the drawbacks discussed above.

OBJECTS AND BRIEF SUMMARY OF THE INVENTION

An object of the invention is to provide an internal antenna for mobile communication devices which, although very small as compared to conventional antennas, yet is nevertheless capable of operating at high efficiency.

Another object of the invention is to provide an internal antenna for mobile communication devices displaying low Specific Absorption Ratio (SAR) with respect to the radiation at the head/body of a human person.

A further object of the invention is to provide an internal antenna for mobile communication devices wherein operation in the vicinity of a human head/body does not significantly interfere with the performance of the antenna.

Another object of the invention is to provide an internal antenna for mobile communication devices that can efficiently operate in wide frequency bands—single, dual or multi-band.

A further object of the invention is to provide an internal antenna for mobile communication devices that can be manufactured inexpensively in volume as compared to the conventional external antennas.

Yet another object and advantage of the invention is to provide an internal antenna for mobile communication devices that presents a more aesthetic appearance than the comparable devices equipped with conventional external antennas.

According to one aspect of the present invention, there is provided a multi-band microwave antenna which is resonant and radiant at a high frequency band and at least one lower frequency band, comprising: a dielectric substrate having opposed faces; an electrically-conductive layer serving as a ground plane on one face of the dielectric substrate; an electrically conductive feed line carried on the opposite face of the dielectric substrate, the feed line having at least one feed end and at least one load end; a slot formed in the ground plane having a feed side and a load side with respect to the feed end and load end, the slot being electromagnetically coupled to the load end of the feed line such that the slot is resonant and radiant at the high frequency band; and a further electrical conductor electrically connected to the ground plane to serve as a continuation thereof at the load side of the slot, the further electrical conductor being dimensioned, located and electromagnetically coupled to the slot at the lower frequency band such as to cause the slot to be resonant and radiant also at the at least one lower frequency band.

The explanation for the enhancement in the lower operational frequency is as follow: Electrical current are generated along the ground plane of the antenna, which contribute to the radiation of the antenna. In a finite ground plane, these currents generate electric and magnetic fields at both ends of the ground plane (those ends which are perpendicular to the direction of propagation of the currents), acting like a patch antenna. The currents generated along the ground plane must be continuous and therefore, if the size of the ground plane is small, no significant current amplitude will be achieved, (theoretically, around one-half wavelength is required for maximum current to be generated). By adding the second ground plane, the generated currents do not need to vanish at the first ground plane's edge and thus contribute to the radiation of the slot. The reason for the order of one half wavelength is based on the phase of the current which has a difference of 180° at both edges. The generated field at the edges, which are the product of multiplication of the current and the normal to the edge (which is opposed in direction at both edges) yields in-phase electromagnetic fields and hence contribute to the radiation at desired directions.

In order to keep the antenna surface small as usually required for mobile communication devices, the second ground plane may be folded or placed above or below the first ground plane, and then the two layers may be connected by pins or other metal members to achieve this continuation of the ground plane and the generated currents. The latter enables the continuation of the currents without affecting the vicinity of the antenna. This added layer may be located in the gap required between the antenna and the communication device, so the total volume remains the same. This gap is required in order to eliminate cancellation of the electromagnetic field/s due to reflected fields off the mobile communication device's PCB.

The electrical conductor serving as a continuation of the ground plane may also be in the form of an added stub. Such an implementation of the invention saves the need for an extra layer, simplifying the manufacturing and assembly processes, as well as reducing the antenna cost. Plated-through-holes (PTH), metal pins, pads, or any type of electrical conductive members may connect the ground plane on one side and the added stub on the other side.

The entire antenna may be produced on a single-layer flexible printed circuit board then folded thereby eliminating the need for a separated second layer and special connections thereto. It may also be produced on a single dielectric substrate in which the electrical conductor serving as a continuation of the ground plane is formed on the same face as the feed lines but insulated therefrom.

The width of the electrical contacts controls the operational frequency of the lower band. A narrow connection lowers the operational frequency of the lower band, while a wider connection increases the operation frequency of the lower band. The connection may be of the inductive type to act as a low pass filter, and therefor would hardly affect the upper band.

The connection of the antenna to the mobile communication device can be through conductive pins. Either cylindrical, flat or other cross-section pins can be used. The pins can be spring-loaded pins, rigid pins with elastic elements on either the communication device's PCB or the antenna, or threaded rigid pins. In another embodiment, conductive pins can be soldered to the communication device.

Another method of connection can be through a coaxial connector. The connection can also be made using a flexible PCB as the substrate of the antenna, which can be directly mounted or connected via connector or through pins to the PCB of the communication device.

In the preferred embodiments of the invention described below, the antenna is of the type described in the above-cited U.S. Pat. No. 5,068,670 (of one of the joint inventors in the present application and incorporated by reference herein), in that it includes an electrically conductive feed line carried on a face of a dielectric substrate opposite to that serving as the ground plane, and a slot formed in the ground plane having a feed side electromagnetically coupled to the feed end of the feed line, and a load side electromagnetically coupled to the load end of the feed line, such that the slot is resonant and radiant at a predetermined high frequency band.

According to another aspect of the present invention, the slot formed in the ground plane of such an antenna is curved.

The enhancement achieved by curving the slot is in reducing the overall size of the antenna board. Especially in the case of a slot with both ends shorted, the effect of curving the slot is minimal regarding performance, since the side arms of such slot are in the neighborhood of the slot's ends. As described earlier, the electric and magnetic fields in a short ended slot vanish at the end of such slot, and since they must be continuous, it follows that their values near the ends of the slot are low and hence are not effected by curving the slot. The region near the center of such slot is most significant, and the values of the fields are high.

The combination of such curved slot and a distributed feed line (preferably similar on that described in U.S. Pat. No. 5,068,670) provides particularly good results especially with such small antennas.

A typical antenna dimension in a typical DCS/PCS frequencies (1800 and 1900 MHz) should be around 60–80 mm. The size is impractical for modern mobile communication devices, where a typical room for an internal antenna is in the range of only (35–45) mm×(20–30) mm. Prior art slots used so far, such U.S. Pat. Nos. 5,929,813 and 6,025,802 (by Nokia) are fed directly by pins. Further, the structure suggested by these patents are, in fact, loop antennas rather than slot antennas. Further, the structure suggested by these patents are, in fact, loop antennas rather than slot antennas.

PCT/US99/0085, WO 99/36988 (by Rangestar) presents slot antennas for cellular handsets. This suggested antenna is fed by coax and therefore there is no room for any impedance matching rather than the excitation point position along the slot. This configuration is also complex regarding assembly, since it must be soldered, and the wires of the coax may be often broken. Furthermore, the slot is straight rather than curved and is very small in length as compared to the wavelength at the operating frequency, and hence its efficiency is inherently very poor.

Thus, curving the slot while yet exciting it by a distributed feed line having a feed end (preferably including a transformer effected by changing its length and width in order to match the slot impedance) and a load end (which includes a reactive load—either an open stub, short stub or lumped elements for mainly reducing the reactive part of the slot impedance to a level of zero) provides particularly good results when curving the slot, and exciting it by a distributed feed line.

A multi slot configuration can be made according to the present invention, by having two slots excited either serially by the same feed line, e.g., crossing the first slot at its excitation point, continuing to second slot, crossing the second slot at its excitation point, and then having the load end part of the feed line. This embodiment enables the entire antenna to operate at the further frequency bands.

According to a further preferred embodiment, each of the slots may be excited by a separate feed line, the feed lines being in parallel to each other.

In another configuration according to the present invention, a further feed line may excite each of the two slots, while each of the feed lines constructed according to either the series or parallel methods as above-mentioned. It is to be appreciated that any combination of series and parallel feed lines may apply to the latter antenna according to the present invention.

The electrical connection to the antenna can be at any suitable point on the antenna. For example, plated through holes may be produced on the antenna PCB at a pre-design stage, and pins from the communication device's PCB may be inserted into these holes and soldered. In another possible arrangement, spring loaded pins may produce the electrical connection by direct contact with pads on the PCBs of the antenna and the communication device. In a further possible arrangement, electromagnetic coupling between a feed line on the communication device's PCB and the antenna can make the electrical connection to the antenna.

A preferred implementation is to have the antenna (or at least one of its layers, if more than one) an integral part of the communication device's PCB. In the most general case, the device's PCB is a multi-layer PCB, and the antenna can be easily produced directly on that PCB, thereby eliminating any need for any further connection or a separated PCB. The conductive reflector if applicable as a separate layer may then be a simple metal sheet placed close to the front cover of the device's PCB, being electrically connected to the antenna, e.g. by conductive pins.

A further implementation is to have the upper layer of the device's PCB a flexible layer, containing the antenna and the conductive reflector on it, in which either the ground panel or the conductive reflector panel is folded to produce the final antenna.

Another preferred embodiment is to have the antenna an integral part of the communication device's battery, which is usually placed on the backside of the communication device. In such structure, the contact elements will preferably be of the type of spring-loaded pins. A preferred position to place the antenna is in the top of the back side of the communication device, in order to minimize interference with its operation and performance while holding the communication device in the user's hands and/or near the user's body/head.

It will thus be seen that the present invention may be implemented by an antenna comprised of a resonant slot (i.e., "short ended" slot) cut in a ground plane of a printed circuit board, excited by at least one feed line crossing the slot at least at a single excitation point along the slot. This excitation point is designed to optimize the slot impedance to the feed line point at the desired operation frequency. The excitation may also be performed by a dual feed line, to excite the slot symmetrically to ensure symmetrical radiation of the slot, or asymmetrically to widen the frequency bandwidth of operation by a combination of two different excitations. In order to enhance the antenna efficiency, the load end side of the feed preferably is of a reactive type rather than a matched load. The design of the feed end of the feed line and the load end of the feed line may be made according to U.S. Pat. No. 5,068,670, to maximize the operational bandwidth of the antenna. The slot is preferably curved on the ground plane in which it was cut in, in order to ensure the small size of the antenna.

The load end is, as above-mentioned, of a reactive load type. It may be a shorted stub (simulating a short circuit, where the end of the stub is connected to the ground plane, e.g., by a plate-through-hole), and opened stub (simulating an open circuit), or lumped element/s (simulating a reactive load which may represent an impedance other than a short circuit or open circuit). Any combination of reactive loads may serve as the load end of the described antenna constructions.

As previously mentioned, modern mobile communication devices now require dual or triple band of operation. Therefore, the slot is designed to operate in the higher band/s (e.g., in the 1800 and/or 1900 MHz for cellular phone devices). In order for the antenna to operate also in the lower frequency band (e.g., in the 800 and/or 900 MHz for cellular phone devices), an extension of the ground plane may be produced at the far end of the slot by means of a sheet of metal electrically connected to the edge of the ground plane to add a further band of operation to the antenna (e.g. in the 800 and/or 900 MHz for cellular phone devices). The added piece of ground plane, together with the PCB of the mobile communication device, both tune the lower operational frequency band. Since the PCB of the communication device is pre-produced and in most cases is independent of the antenna design, the tuning is usually controlled by the shape, length, width and type of connection of the extended ground plane.

The above-mentioned extended ground plane may be applied on a PCB folded to the other side of the antenna's PCB or as a second layer placed either at an angle, or parallel, to the antenna's PCB in order to save surface of the antenna. In a preferred implementation, the ground plane extension is made by means of feed line stubs on the other side of the antenna's PCB and electrically connected to the ground plane by plated through hole/s or conductive pin/s. These stubs are designed so they do not significantly interfere with either the feed/s and load/s of the feed line exciting the slot or the slot itself.

Further features and advantages of the invention will be apparent from the description below.

BRIEF DESCRIPTION OF THE DRAWINGS

The invention is herein described, diagrammatically and by way of example only, with reference to the accompanying drawings, wherein:

FIGS. 17*a* and 17*b* illustrating the opposite faces of the PCB of FIG. 17, FIG. 17*c* illustrate a side view.

FIGS. 18 and 18*a*–18*c* illustrate similar construction to FIG. 17 but with one feed line.

DESCRIPTION OF PREFERRED EMBODIMENTS

Figure 1:
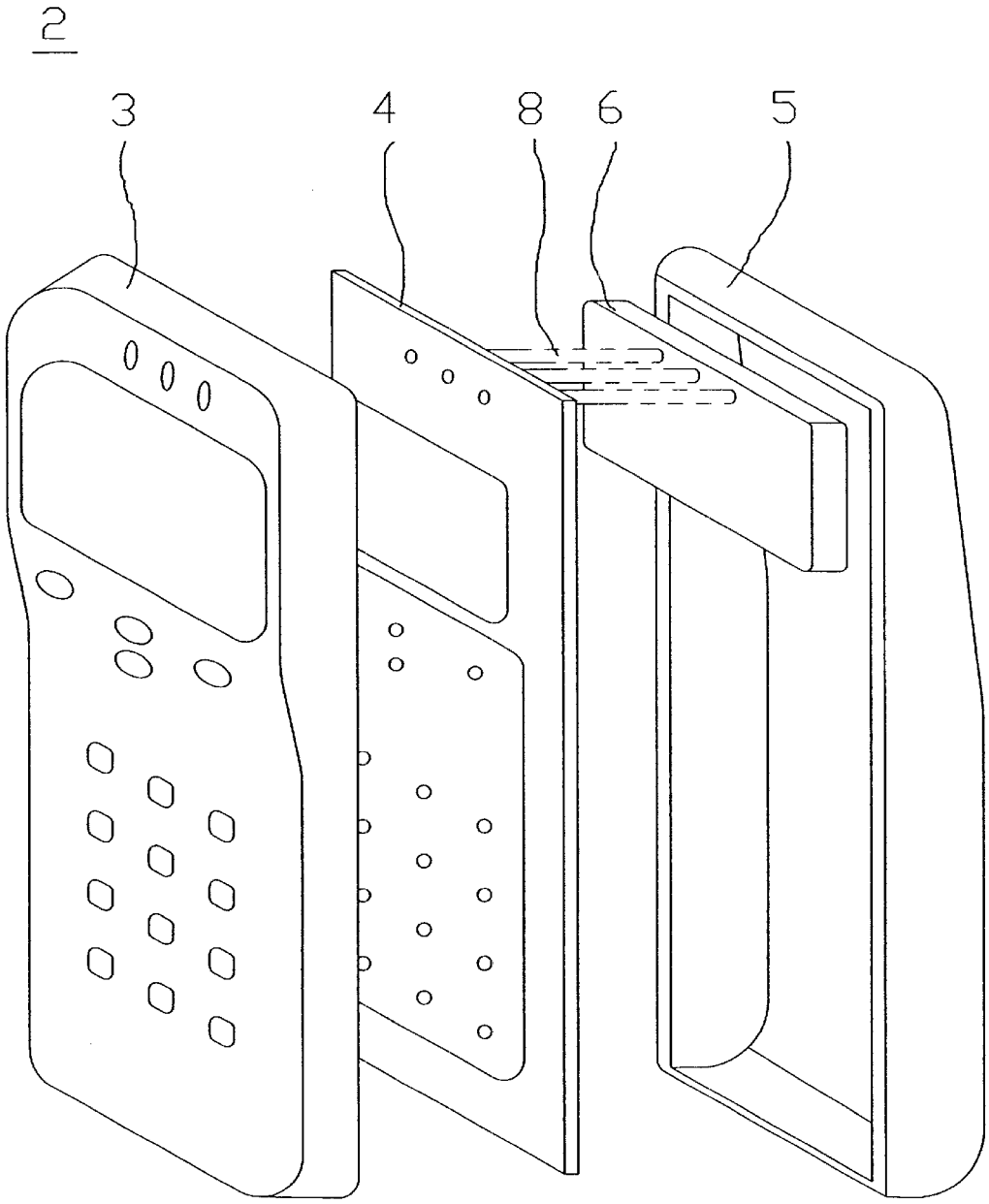
FIG. 1 illustrates one form of mobile communication device including one arrangement for incorporating therein an internal antenna constructed in accordance with the present invention.

FIG. 1 illustrates the main components of a mobile communication device, such as a cellular telephone handset, constructed in accordance with the present invention. Such a device, generally designated 2, includes a front cover 3, a main PCB (printed circuit board) 4, and a back cover 5 usually also containing the battery (not shown). The foregoing components may be conventional, and therefore further details are not set forth.

Figure 2:
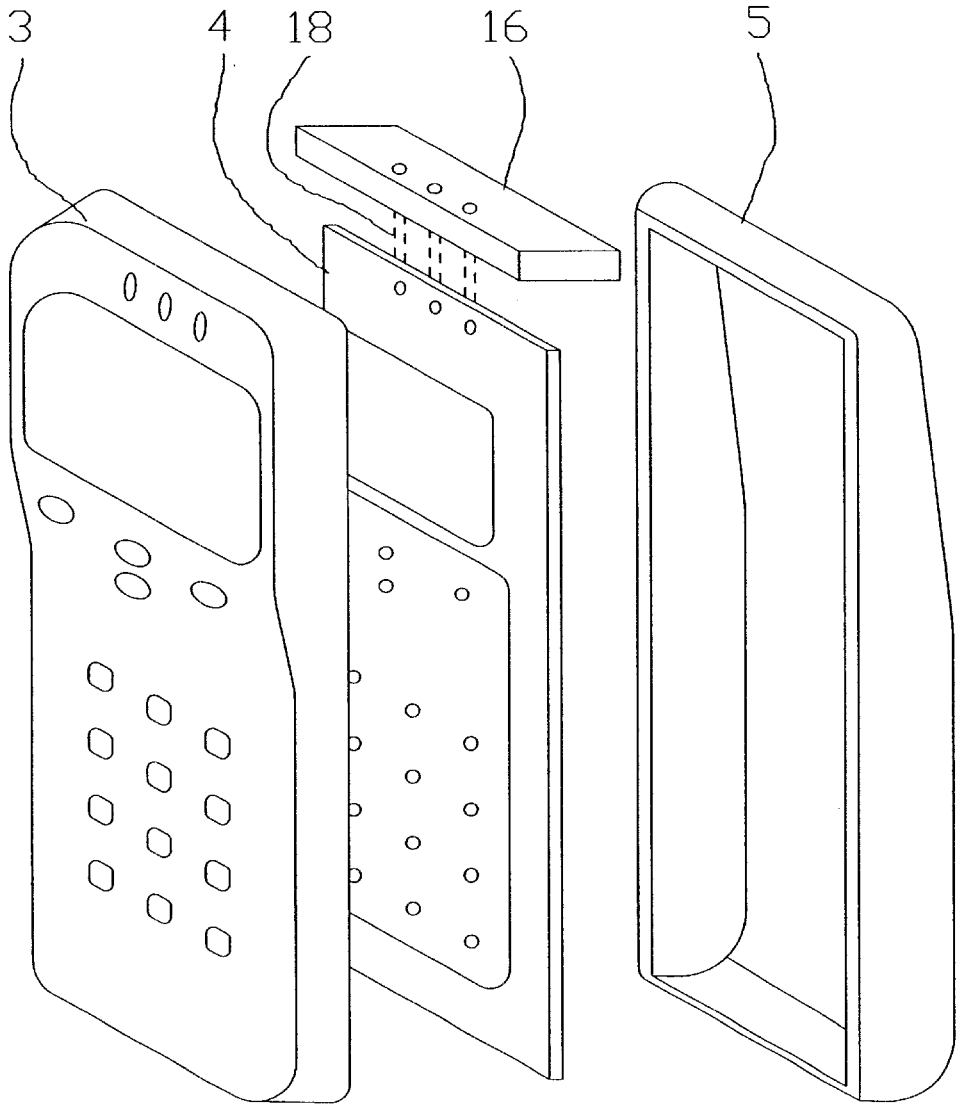
FIG. 2 illustrates a mobile communication device including another arrangement for incorporating therein an internal antenna constructed in accordance with the present invention.

In accordance with the present invention, the mobile device 2 includes an internal antenna, generally designated 6, disposed between the main PCB 4 and the back cover 5 and connected to the PCB by feeding pins 8. In the embodiment illustrated in FIG. 1, the internal antenna 6 is located substantially parallel to the plane of the main PCB 4 to which it is connected by the feeding pins 8. FIG. 2 illustrates a variation wherein the internal antenna, therein designated 16, is disposed substantially perpendicular to the main PCB 4 to which it is connected by feeding pins 18.

The present invention deals primarily with the structure of the internal antenna e.g. 6, 16, as described below particularly with respect to the various embodiments of such an internal antenna as illustrated in FIGS. 3–16.

FIGS. 3 and 3*a*–3*c* illustrate one preferred construction for the internal antenna 6 in FIG. 1 or the internal antenna 16 in FIG. 2.

Thus, as shown in FIGS. 3 and 3*a*–3*c*, the internal antenna, therein designated 100, is constituted of two panels 101, 102 mechanically and electrically connected together along one edge by one or more electrically conductive pins 112 (only one being shown) passing through plated-through-holes (PTH) 111*a*, 111*b*. It will be appreciated that spring loaded pins, or other pin types, may be used for connecting the two layers.

Panel 101 is a PCB (printed circuit board) constituted of a dielectric substrate having an electrically-conductive layer 103 on one face, serving as the ground plane and cut with a resonant slot 104. Slot 104 is of curved, U-shaped configuration, closed at both of its ends, to define two closed side arms 104*a*, 104*b* joined by a bridge 104*c*. Resonant slot 104 is excited by an electrically conductive feed line 105 carried on the face of the dielectric panel 101 opposite to that of the ground plane 103.

Figure 3:
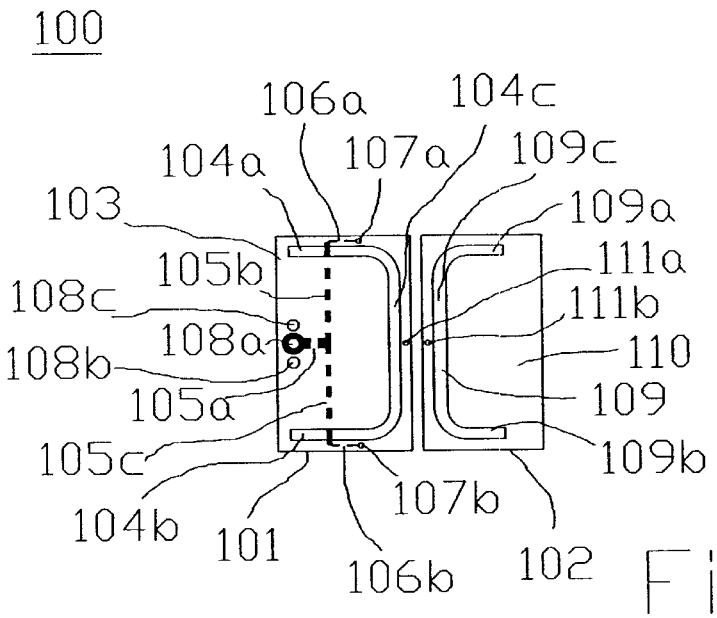
FIG. 3 illustrates one form of internal antenna constructed in accordance with the present invention in its unfolded condition, FIGS. 3*a*–3*c* diagramatically illustrating how such an antenna may be folded.

The embodiment illustrated in FIG. 3 is a symmetric construction, wherein the two side arms 104*a*, 104*b* are substantially parallel, or substantially the same length and width, and are excited by a common excitation point, namely the point where the feed line 105 crosses the slot. It will be appreciated, however, that the antenna could be of a non-parallel, and/or an asymmetrical structure, wherein the closed side arms 104*a*, 104*b* are non-parallel, have different lengths or widths, and/or are non-symmetrically excited by the feed lines, respectively.

The electrically conductive feed line 105 (dashed line in FIG. 3) carried on the opposite side of the PCB excites the slot 104. The main feed line arm 105*a* connects the input signal pin 108*a*, passing through a PTH, dividing the power into two feed line transformer sections 105*b* and 105*c*, exciting the slot 104 at two points. The transformer sections 105*b* and 105*c* can be either identical as in FIG. 3 or different in length and/or width. The feed line sections 105*b* and 105*c* continue from the excitation points underneath the slot and perform the function of reactive loads 106*a* and 106*b*, respectively.

The reactive loads for this embodiment are shorted to the ground 103 on the other side of the PCB via the PTHs 107*a* and 107*b*, respectively. These reactive loads enhance and improve the matching of the slot impedance; that is, they mainly reduce the reactive part of the slot impedance to the order of zero at a broad frequency range. Thus, the transmitted power is electromagnetically coupled off feed lines 105*b* and 105*c* to the slot 104, enabling radiation off slot 104. The same applies to reception, where the received power is electromagnetically coupled off slot 104 to feed lines 105*b* and 105*c*.

The length and/or width of each arm of the feeding line 105, and/or the reactive load 106, and/or each part of the slot 104*a*–104*c*, can be changed. These parameters, as well as the excitation point of the slot, the height above the main PCB 4, and the angle between the antenna 6 or 16 and the main PCB 4, the distance between the pins 8 and the diameter thereof, the substrate type and thickness, etc., set the higher frequency band of the antenna. In this illustrated preferred embodiment of the present invention, the structure is fully symmetric, and hence the radiation pattern off slot 104 will be symmetrical.

An important feature of the present invention is that the Internal antenna 100 is resonant and radiant not only at a predetermined high frequency, as determined by slot 104 cut in the ground plane 103, the feeding line 105, and the reactive loads 106, but also at a lower frequency band, so as to be capable of use as a multi-band microwave antenna. For this purpose, the antenna 100 in FIG. 3 includes a further panel 102 (e.g. a PCB) being an electrical conductor 110, electrically connected to the ground plane 103 by an electrically-conductive pin 112 (FIGS. 3*b*, 3*c*) inserted in PTHs 111*a* and 111*b* preformed in panels 101 and 102, respectively. Electrical conductor 110 thus serves as a continuation of the ground plane 103 at the load side of the slot 104. A slot 109 cut in electrical conductor 110 acts as an electromagnetic load for slot 104 at the lower frequency band such as to cause the slot to be resonant and radiant also at a lower frequency band. The length and/or width of each arm 109*a*–109*c* of slot 109 can be changed, as well as the direction of the opening the slot and slot's position on electrical conductor 110. The slot 109 may be different in length, width and shape as compared to slot 6 or 16. These parameters affect the low frequency's behavior of the antenna 100.

The electrical conductor 110, in addition to its contribution to the lower frequency band, also assists in reducing radiation at the user's head by serving as a reflector for reflecting the electromagnetic waves scattered by slot 104; it thereby also reduces the SAR level. Depending on the type and structure of the antenna, the SAR is reduced by about 3 dB in a typical CDMA/TDMA/GSM frequency bands (800 and 900 MHz), and by more than 5 dB in a typical PCS/DCS frequency bands (1,800 and 1,900 MHz). Further, the very high efficiency of the antenna enables the transmitted RF power level of the communication device to be reduced, and thereby increases the user's safety as well as the battery operational cycle between charges.

As indicated earlier, FIG. 3 illustrates a slot 104 having a symmetrical dual feed structure by transformer sections 105*b* and 105*c* and reactive load 106*a* and 106*b*. FIG. 3 illustrates, three feed pins used according to that embodiment; a signal feed pin 108*a*, and a pair of ground pins 108*b* and 108*c* on opposite thereof. Such an arrangement maintains the structure's symmetry and also reduces the characteristic impedance of the transmission line representing the pins. The characteristic impedance of a three-pin symmetrical structure is about one-half the characteristic impedance of a two-pin structure. This makes it easier to match the antenna to the output impedance of the transmitter and/or the input impedance of the receiver through these pins.

The reactive load 106 matches the reactive part of the impedance of the slot 104 at each excitation point at the higher band. The reflector 102, in addition to all parameters described above as affecting the high frequency band, also matches the slot impedance in the lower band. The combined impedance generated by the slot 104 and the reactive load 106, or the reflector 102, is transmitted by the transformer sections 105*b* or 105*c* to the junction between the main feed arm 105*a* and the transformer sections 105*a* and 105*b*. Both impedances, from the two sides, are combined and mirrored through the main feed arm 105*a* and the input pins 8 to the handset. The slot 104, the reactive load 106, the panel 102 (reflector 110), the feed line 105, and the input pins 8 may be designed to ensure wide band operation for the antenna, i.e., both at the lower band, and at one or more higher bands.

Figure 3A:
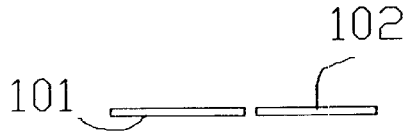
Figure 3B:
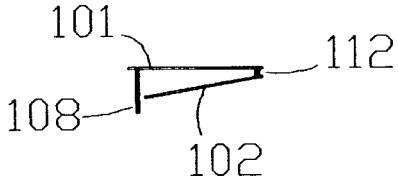
Figure 3C:
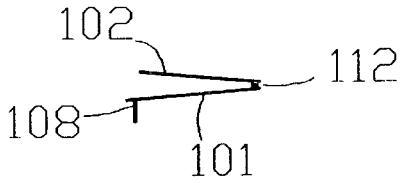

FIG. 3*a* illustrates a side view of the two panels 101, 102, before they are mechanically and electrically connected; FIG. 3*b* illustrates one manner of connecting the two panels, such that panel 101 containing the ground plane 103, slot 104 and feed line 105 overlie panel 102 containing the reflector 110 and slot 109 (may also be asymmetrical); whereas FIG. 3*c* illustrates the reverse arrangement wherein panel 102 overlies panel 101. An important antenna parameter is the angle formed between the two panels 101, 102. It is possible to change the angle between the panels, to change the panel which is the overlying one, as well as to change the face of the panel facing upwardly, but such changes would require fine tuning of the feed line. In addition, while FIGS. 3, 3*a*, and 3*b* illustrate the two panels as being mechanically and electrically interconnected together by a single pin 112 received within plated through holes 111*a* and 111*b*, respectively, in the two panels, it will be appreciated that a plurality of such pins and PTHs may be used for this purpose.

Figure 4:
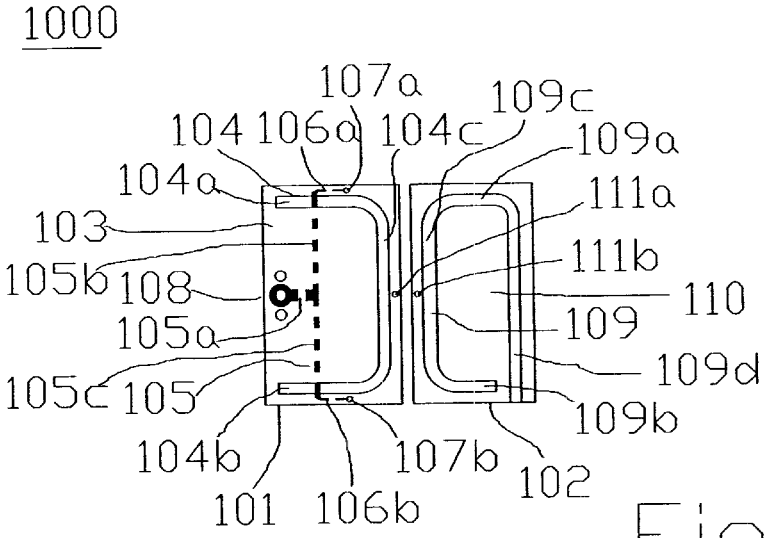
FIGS. 4*a*–4*c* illustrate a construction similar to that of FIG. 3, but with a reflector slot open at one end, rather than closed at both ends as in FIGS. 3.
Figure 4A:
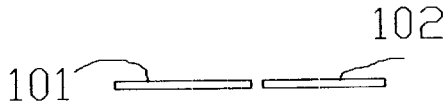
Figure 4B:
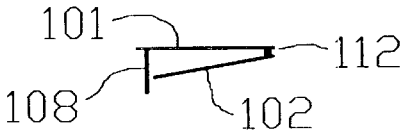
Figure 4C:
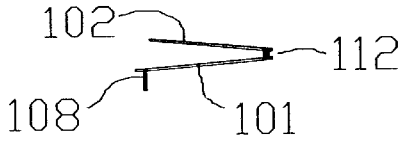

FIG. 4 illustrates an antenna, designated 100', similar antenna 100 of FIG. 3, except the slot 109 in the conductive reflector 110 is open at one end, as shown by arm 109*d* in FIG. 4.

Figure 5:
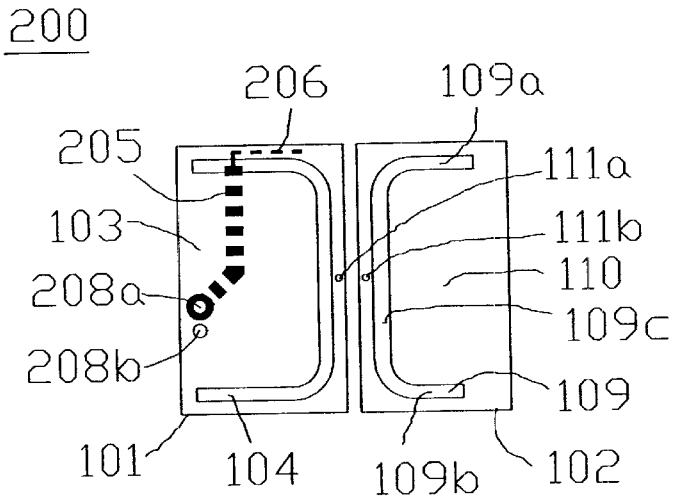
FIG. 5 illustrates another form of internal antenna constructed in accordance with the present invention also in its unfolded condition, FIGS. 5*a*–5*c* diagramatically illustrating how such an antenna may be folded.
Figure 5A:
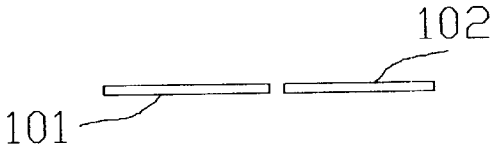

FIG. 5 illustrates another construction of internal antenna, therein generally designated 200, which is similar to the one illustrated in FIG. 3, except that it includes only two feeding pins, namely, one signal pin 208*a* and one ground pin 208*b*. This changes the characteristic impedance of the transmission line representing the electrical interface between the antenna and the handset. The location of the two feeding pins 208*a*, 208*b* is off the center of the antenna; therefore, the radiation pattern is asymmetrical.

As seen in FIG. 5, in this embodiment the excitation of the slot 104 in panel 101 is by a single feed line 205 and a single excitation point; also the reactive load 206 is open-ended. This feed also makes the radiation pattern of the antenna asymmetric.

The length and width of the feed line or the reactive load as well as the excitation point, can be changed. The reflector panel 102 includes a closed slot 209 cut in a conductive layer 110, as in FIG. 3. The characteristic of reflector slot 209 can be different from the radiating slot 104 in the ground plane 103. The closed side arms 209*a* and 209*b* of the reflector slot 209 can be either identical or can differ from each other in length and width.

Figure 5B:
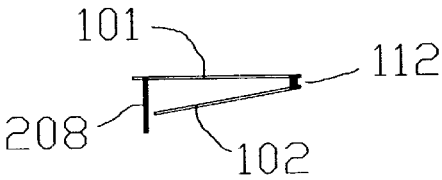
Figure 5C:
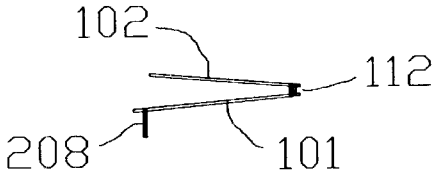

The two panels 101, 102 may be mechanically and electrically secured together in the desired relationship, and at the desired angle, by one or more electrically-conductive pins shown at 112 in FIGS. 5*b* and 5*c*. As described above with respect to FIGS. 3 and 3*a*–3*c*, the relationship between the two panels, and the angle defined by the two panels, may be altered according to the particular application, and the feed line can be fine tuned according to the desired order of panels and angle between the panels.

Figure 6:
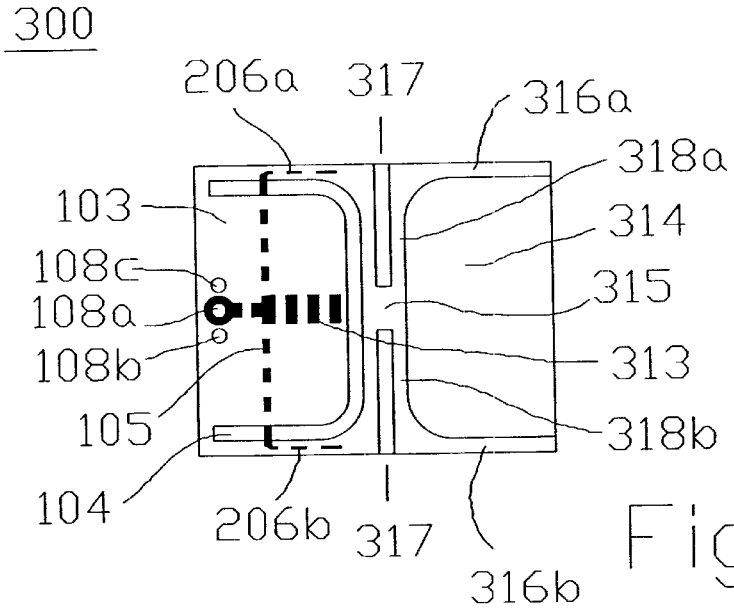
FIG. 6 illustrates an internal antenna constructed in accordance with the present invention on a single flexible PCB (printed circuit board) in its unfolded condition, FIGS. 6*a*–6*c* diagramatically illustrating how such an antenna may be folded.

FIG. 6 illustrates an internal antenna, therein generally designated 300, which is similar to the antenna of FIG. 3 but is built on a single, double-size, double-sided, flexible PCB panel, rather than on two rigid PCB panels. Such a construction eliminates the need for the PTHs 111, and pins 112 in the assembly of FIG. 3. The two faces A, B of the single flexible panel illustrated in FIG. 6 are prepared with the various elements as described above with respect to FIG. 3, and as shown in side view in FIG. 6*a*; and the single panel is then simply folded along the fold axis 317 to a predetermined annular position as shown in FIG. 6*b* or in FIG. 6*c*, according to the particular application.

The feed pins 108*a*–108*c*, and the feed line 105, are similar to those described above with respect to FIG. 3. The reactive load 206 is an open reactive load, as in FIG. 5. The main difference in the antenna of FIG. 6 is the addition of the open-ended tune stub 313. The stub enhances the bandwidth of the antenna, and improves the matching of the antenna to the handset. Its length and width can be changed according to the particular application.

The electrically conductive layer defining the ground plane 103 at one side of the panel is formed with an enlarged cut out or interruption 314 on the opposite side of the panel defining the reflector, to thereby define two stub reflectors 316*a*, 316*b* at the opposite ends of the panel. The length and/or width of the stub reflectors 316*a*, 316*b* can be the same for a symmetric structure, or different for a non-symmetric structure providing a wider bandwidth. The two stub reflectors 316*a*, 316*b* are electrically connected via reflector feeds 318*a*, 318*b*, and electrical juncture section 315 to the ground plane 103. The two reflector feed 318*a*, 318*b* may be of the same length and width for a symmetrical structure, or of a different length and/or width for a non-symmetrical structure to provide a wider bandwidth. The juncture acts like a filter and therefore its dimensions (length and width) affect the low-frequency band.

Figure 6A:
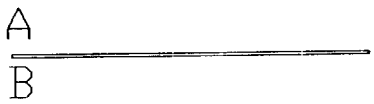
Figure 6B:
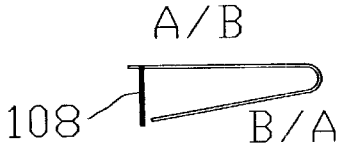
Figure 6C:
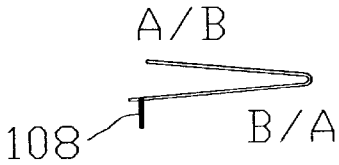

FIG. 6*a* is an end view of the panel of FIG. 6 before it is folded; and FIGS. 6*b* and 6*c* illustrate two possible manners of folding the panel, corresponding to the arrangements illustrated in FIGS. 3*b* and 3*c*, respectively. The shape of portion 314 of the dielectric substrate may be varied, as desired, to change the length and/or width of the stub reflectors 316*a*, 316*b* and of the reflector feeds 318*a*, 318*b*. In addition, the dielectric substrate portion 314 may be formed with one or more openings to accommodate the feeding pins 108.

Figure 7:
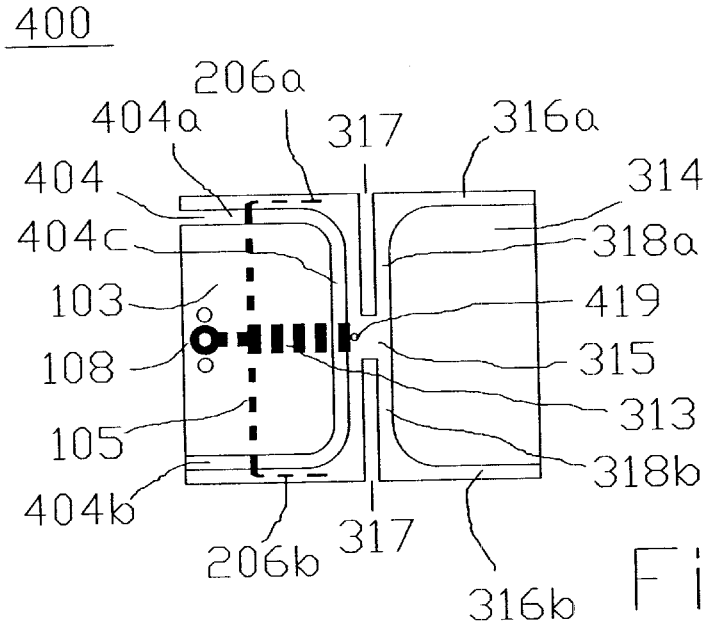
FIG. 7 illustrates an internal antenna constructed on a single flexible PCB in accordance with the present invention.

The antenna illustrated in FIG. 7, therein generally designated 400, is similar to antenna 300 illustrated in FIG. 6, and is also constructed on a single flexible panel which is folded to produce the ground plane, slot and feed line on one side, and the reflector on the opposite side. In this case, however, the radiating slot, therein designated 404, now formed in the ground plane 103 is open ended, on both ends; that is, its two side arms 404*a,* 404*b* are open at one side and joined at the opposite side by a bridge 404*c*. For this reason, the excitation of the slot 404 is different from that described above with respect to FIG. 6.

Thus, in the antenna structure illustrated in FIG. 7, the tuning stub 313 is shorted to the ground plane 103 via a printed-through-hole (PTH) 419 to perform the main excitation of the slot 404. The feed line 105 with the reactive loads 206 act as a secondary excitation of the slot to achieve a multi-feed excited slot. The open side arms 404*a* and 404*b* can be either identical to each other for a symmetrical structure, or can be of different lengths and/or widths from each other for a non-symmetrical structure. The excitation points of the slot 404 by the feed line can be symmetric or non-symmetric as described above.

Figure 7A:
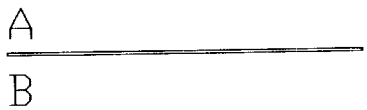
FIGS. 7*a*–7*c* illustrate how the PCB of FIG. 7 may be folded.
Figure 7B:
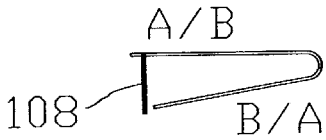
Figure 7C:
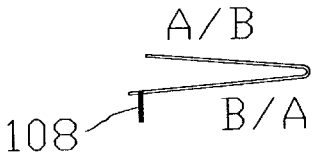

FIG. 7*a* is a side view of the flexible panel of FIG. 7, and FIGS. 7*b* and 7*c* illustrate two possible arrangements for folding the flexible panel corresponding to the arrangements illustrated in FIGS. 6*b* and 6*c,* respectively.

Figure 8:
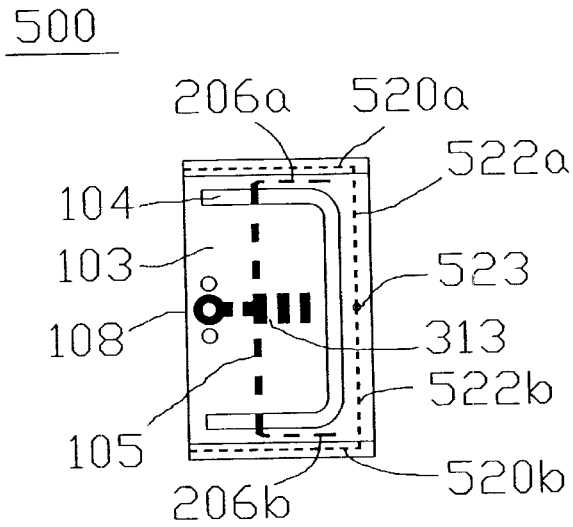
FIG. 8 illustrates an internal antenna constructed on a single rigid PCB layer.
Figure 8A:
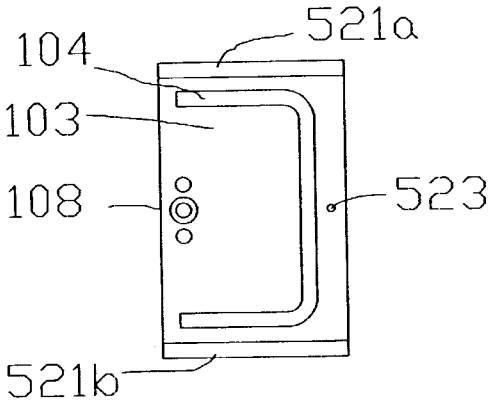
FIGS. 8*a* and 8*b* illustrate the opposite faces.
Figure 8B:
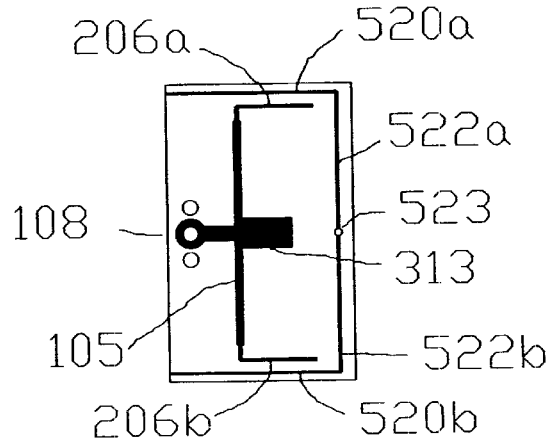
Figure 8C:
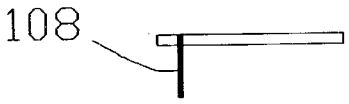
FIG. 8*c* is a side view, of the PCB of FIG. 8.

FIG. 8 illustrates another antenna construction, generally designated 500, wherein the antenna is constructed on a single, rigid PCB panel, having an upper face as shown in FIG. 8*a* and a lower face as shown in FIG. 8*b,* such an arrangement eliminates the need to fold a flexible panel, or to connect together two panels, when assembling the antenna into the handset.

The upper face of the panel (FIG. 8*a*) is provided with an electrically-conductive layer serving as ground plane 103, and with the radiating slot 104 cut in the ground plane. In addition, the electrically-conductive layer in the opposite edges of the ground plane 103 is removed, to provide the interruptions 521*a,* 521*b* in the ground plane.

The opposite face of the PCB, as shown in FIG. 8*b,* is formed with feed line 105, tuning stub 313 and with the reflector comprising the two stub reflectors 520*a,* 520*b* (corresponding to stub reflectors 316*a,* 316*b* in FIG. 7), connected by the reflector feeds 522*a,* 522*b* (corresponding to reflector feeds 318*a,* 318*b* in FIG. 7). In the construction of FIG. 8, however, the stub reflectors 520*a,* 520*b* are excited by a PTH 523 connected to the ground plane 103 in the opposite (upper) side of the PCB. The feed reflectors 522*a,* 522*b,* thus act as transformers to the stub reflectors 520*a,* 520*b,* such that the reflector function in the antenna construction of FIG. 7, is now fulfilled by the stub reflectors 520*a,* 520*b* and feed reflectors 522*a,* 522*b* formed on the same face (lower face) of the PCB panel as the feed line 105 and the tuning stub 313 in the antenna construction of FIG. 8. The interruptions 521*a,* 521*b* in the ground plane provide a further control parameter for the lower frequency band, and may also enhance the radiation and impedance matching of the antenna.

The interruptions 521*a,* 521*b* in the ground plane 103, the stub reflectors 520*a,* 520*b,* and the feed reflectors 522*a,* 522*b* can be symmetrical as illustrated in FIG. 8, or can be non-symmetrical. The dimensions of these elements, including their lengths and/or widths can be varied to control the low band behavior of the antenna. The slot 104 cut in the ground plane 103, the feed line 105, the tuning stub 313, and the reactive loads 206*a,* 206*b,* may be of the same configuration as described above particularly with respect to the antenna of FIG. 6, but their dimensions would be different due to the fact that the length of the ground plane 103 is smaller because of the interruptions 521*a,* 521*b*.

It will be appreciated that the single-panel construction illustrated in FIG. 8 simplifies the manufacture and assembly of the antenna, and therefore reduces its cost.

Figure 9:
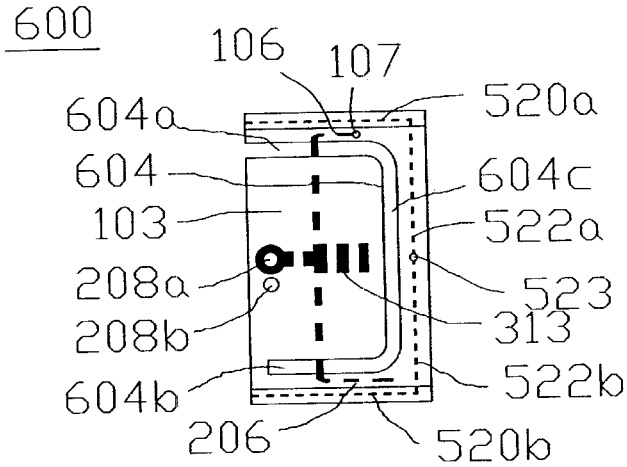
FIGS. 9 and 9*a*–9*c* are views corresponding to those of FIGS. 8 and 8*a*–8*c*, but illustrating a modification in the construction of that antenna.
Figure 9A:
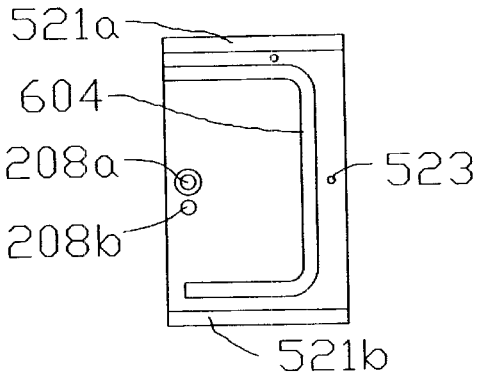
Figure 9B:
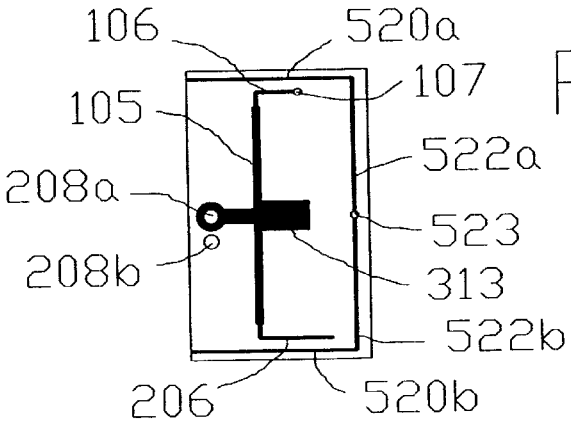
Figure 9C:
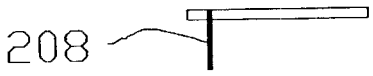

FIG. 9 illustrates an antenna construction, generally designated 600, which is very similar to that of FIG. 8, except the radiating slot therein designated 604, is a half-open slot. That is, one side arm 604*a* is open, and the other side arm 604*b* is closed, the two side arms being connected together to a bridge 604*c*.

Another variation in the construction of antenna 600 illustrated in FIG. 9 is that it includes two feed pins 208*a,* 208*b,* rather than three feed pins 108*a*–108*c* in FIG. 8. The feed line 105 is of the dual-feed type, exciting the two side arms 604*a,* 604*b* of the slot 604.

Further modification is that, in order to have a wide band operation in the high band, two kinds of reactive loads are provided in antenna 600 illustrated in FIG. 9, namely: a reactive load 106 shorted via PTH 107 to the ground plane 103, and a reactive load 206 which is open ended. Such an arrangement provides a non-symmetrical structure, with the operation in the low band being the same as in antenna 500 illustrated in FIG. 8.

Figure 10A:
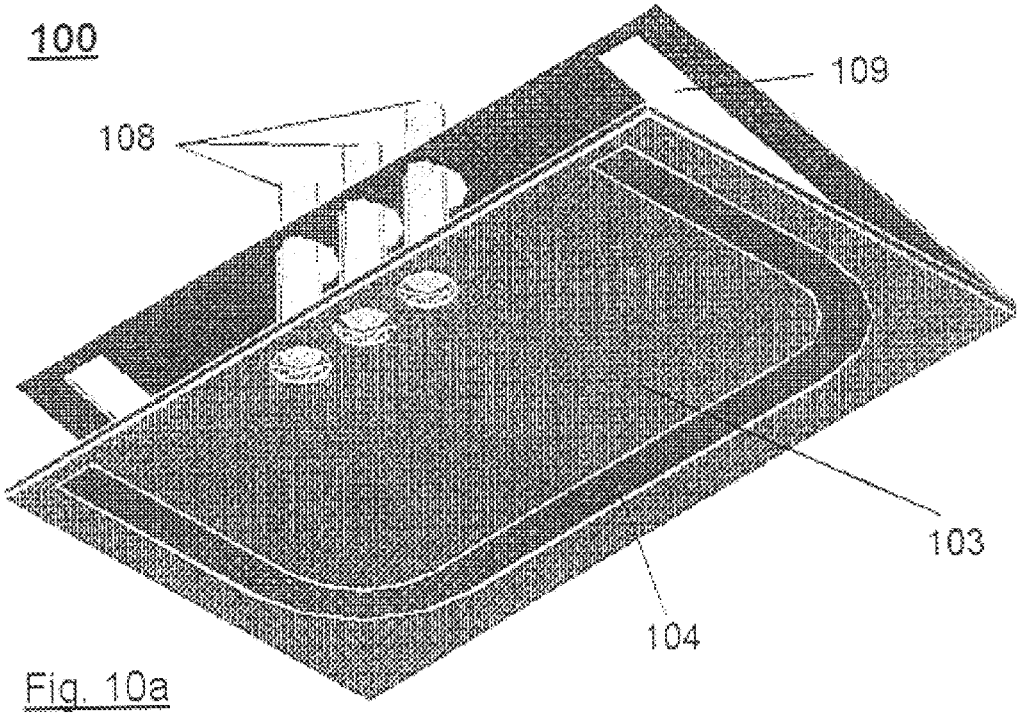
FIGS. 10*a* and 10*b* are two views more particularly illustrating the construction of the antenna of FIG. 3.
Figure 10B:
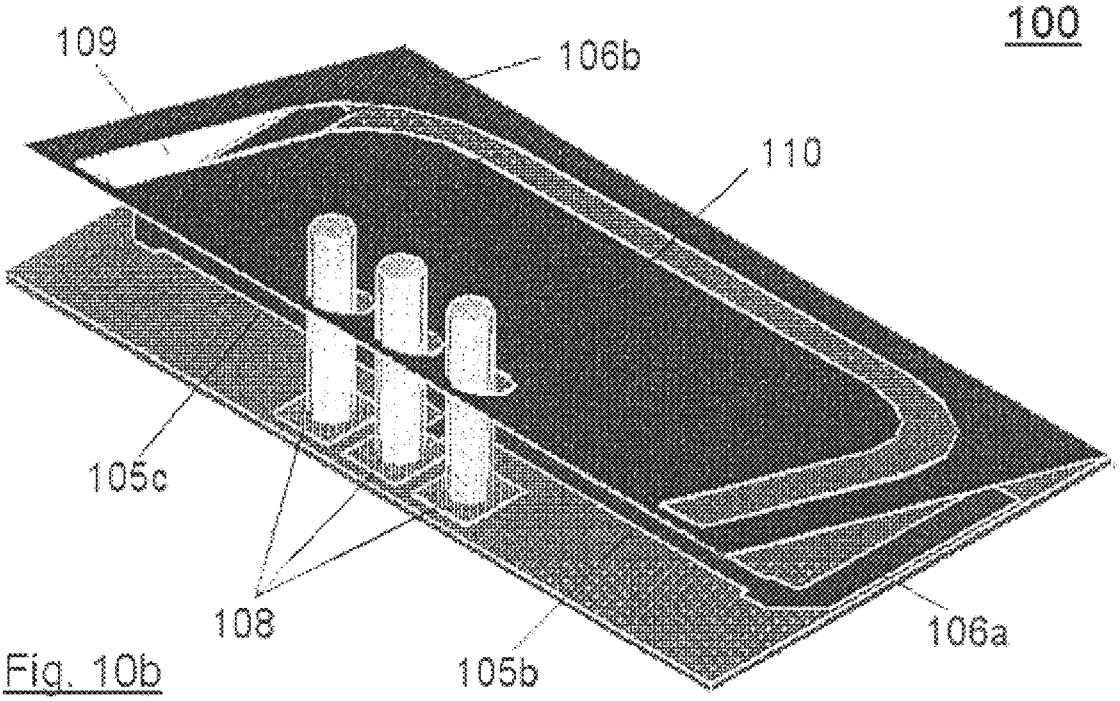

FIGS. 10*a* and 10*b* are two views (from opposite sides) more particularly illustrating the antenna 100 of FIG. 3, and especially the folded arrangement between panel 101 carrying the ground plane 103 formed with the resonant slot 104, and the feed line 105, and panel 102 carrying the reflector 110 electrically connected to the ground plane 103 to serve as a continuation thereof.

Figure 11A:
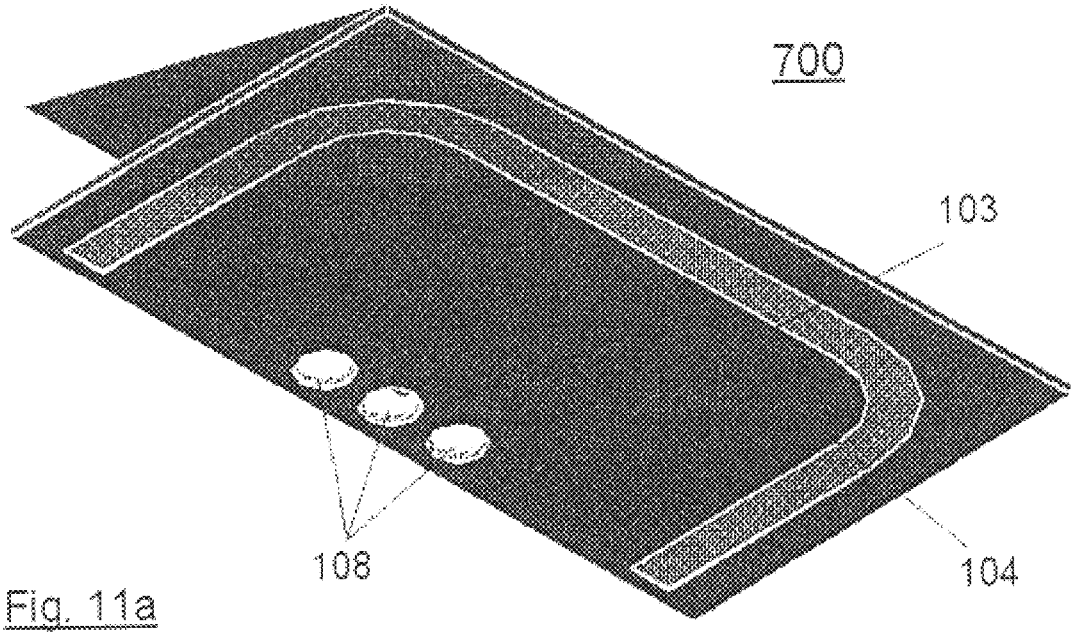
FIGS. 11*a* and 11*b* illustrate two sides of another antenna constructed in accordance with the present invention.
Figure 11B:
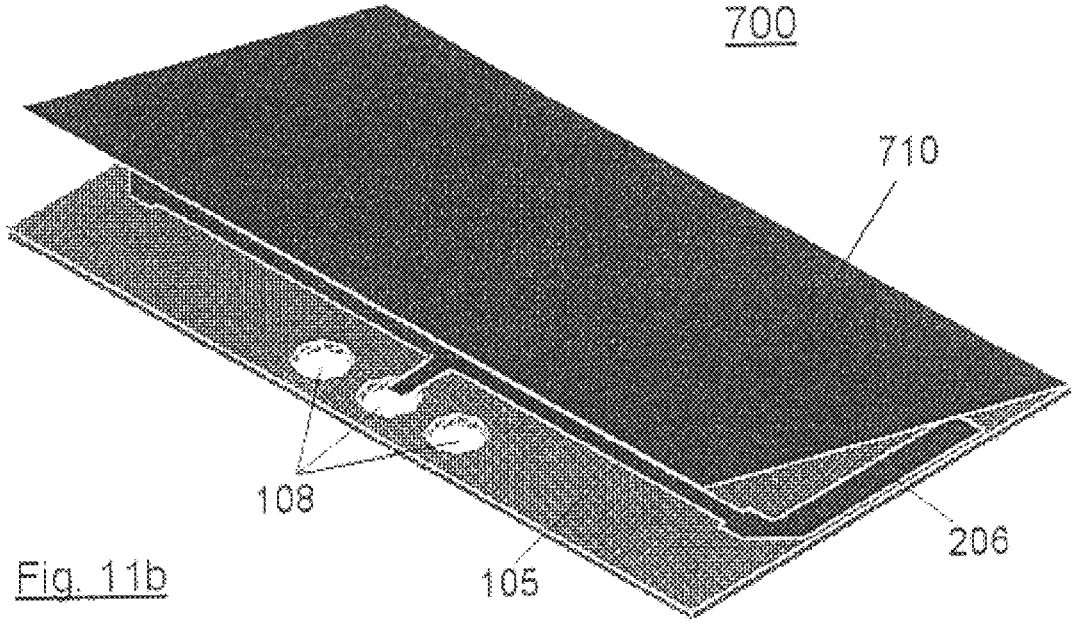

FIGS. 11*a* and 11*b* illustrate the two sides of an internal antenna, generally designated 700, similar to antenna 100 of FIGS. 3 and 7, except that the electrically-conductive layer 710 defining the reflector is continuous and unslotted, rather than being formed with a slot as shown at 104 in FIGS. 3 and FIGS. 10*a* and 10*b*.

Figure 12A:
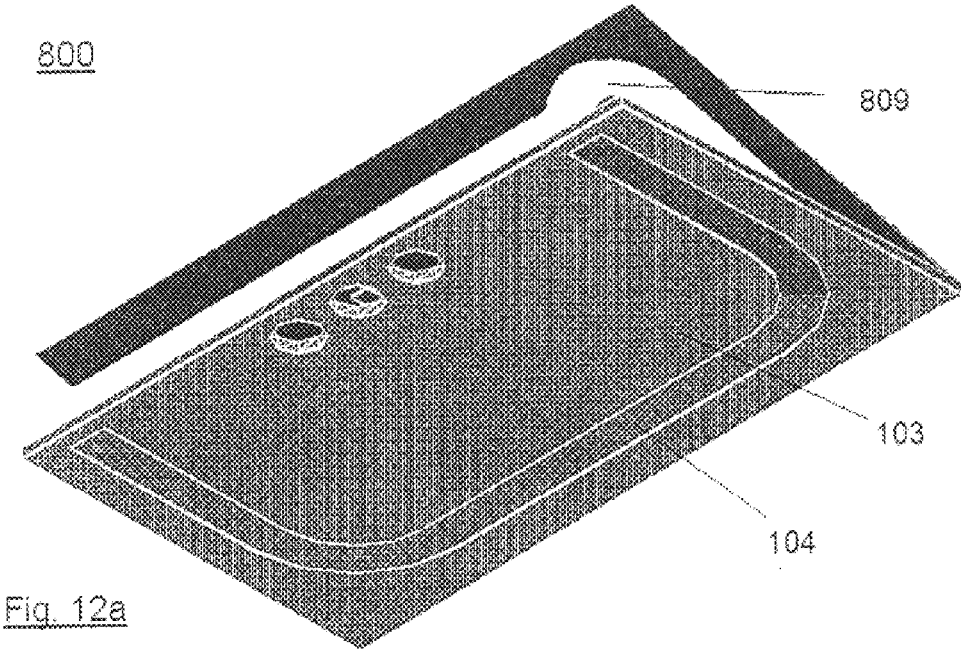
FIGS. 12*a* and 12*b* illustrate two sides of the antenna constructed in accordance with FIG. 4.
Figure 12B:
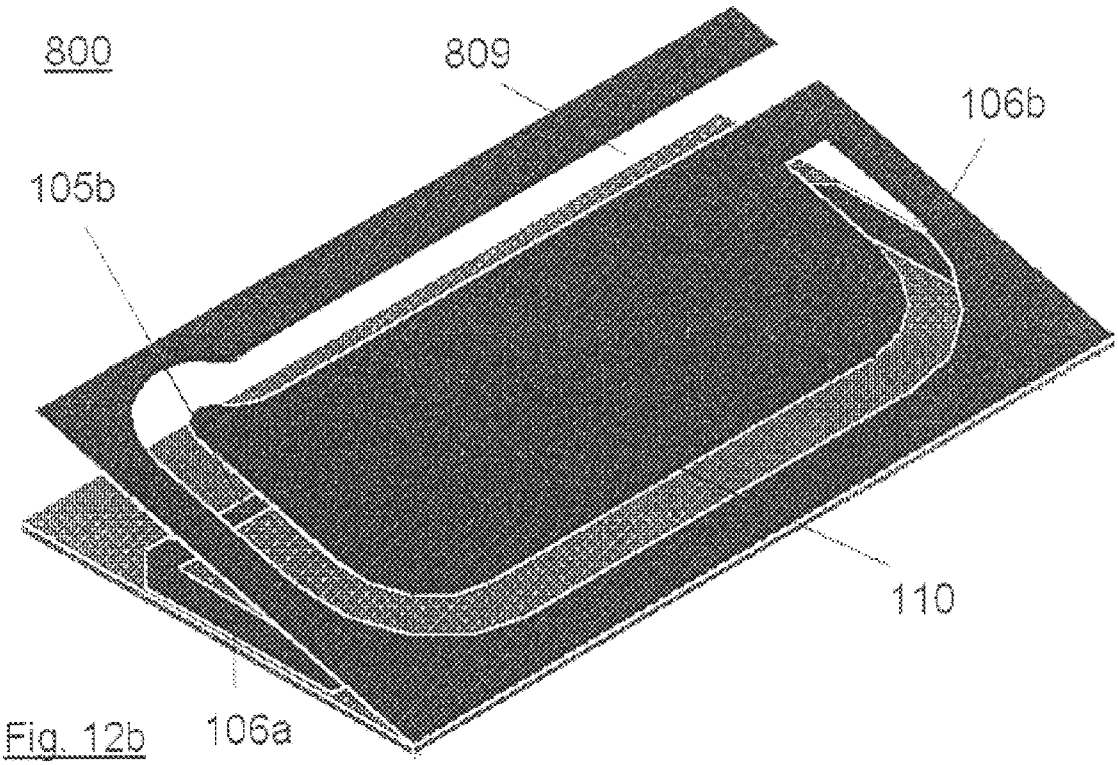
Figure 13A:
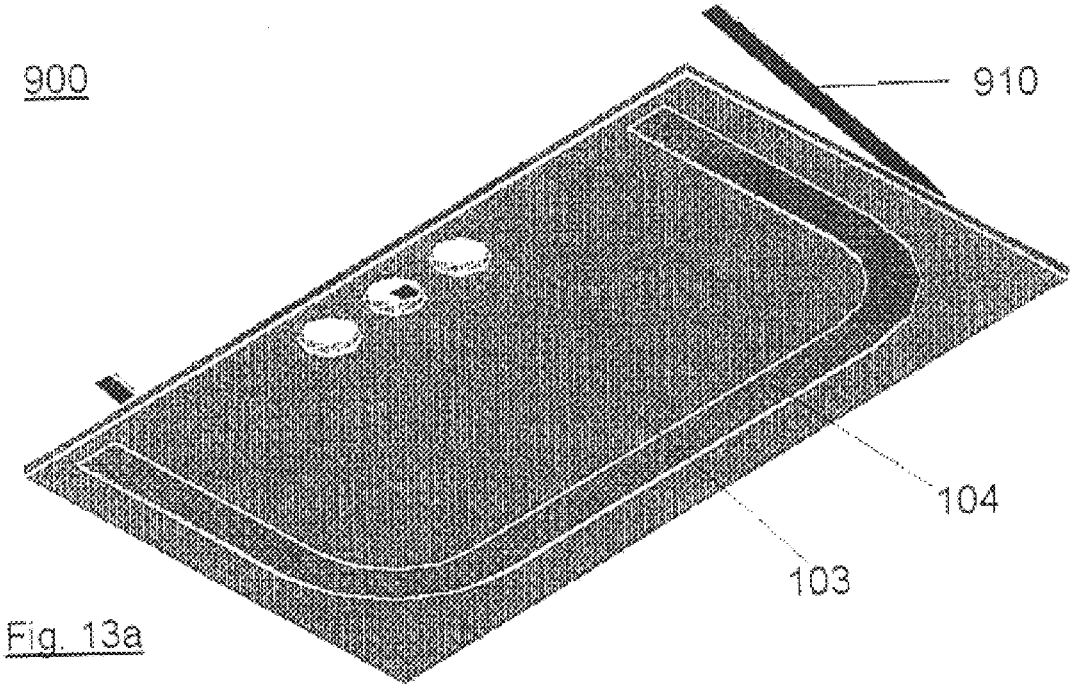
FIGS. 13*a* and 13*b* illustrate another construction of an antenna in accordance with the present invention for a dual feed line.
Figure 13B:
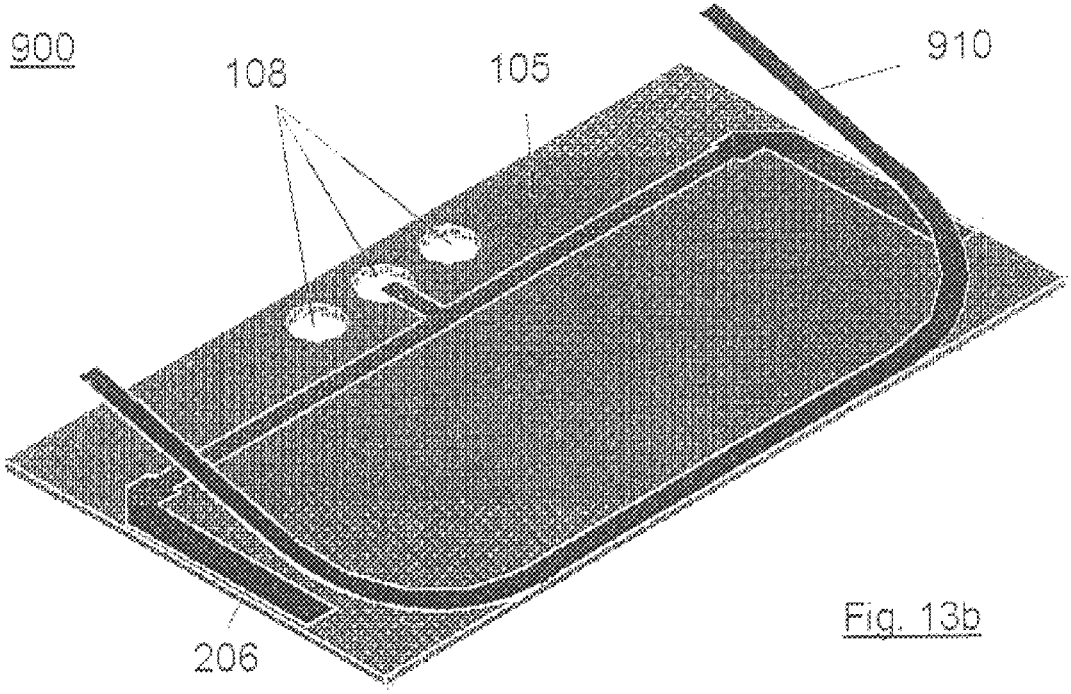

FIGS. 12*a* and 12*b* illustrate the two sides of an internal antenna, therein designated 800, which is also similar to antenna 100' of FIG. 4, except that the slot, therein designated 809, in the conductive layer 810, serving as a reflector and as a continuation of the ground plane, is slightly changed as shown at 809*a,* so as not to be aligned with the ground plane slot 104. FIGS. 13*a* and 13*b* illustrate the two sides of an internal antenna, therein designated 900, also of a similar construction as antenna 300 described above with respect to FIG. 6 in that the electrically-conductive layer, which serves as a reflector and as a continuation of the ground plane, is an electrically conductive strip 910 in the form of a stub reflector corresponding to the stub reflectors and reflector feeds illustrated at 316*a,* 316*b* and 318*a*, 318*b* in FIG. 6, and at 520*a,* 520*b,* and 522*a,* 522*b,* in FIGS. 8 and 9.

Figure 14:
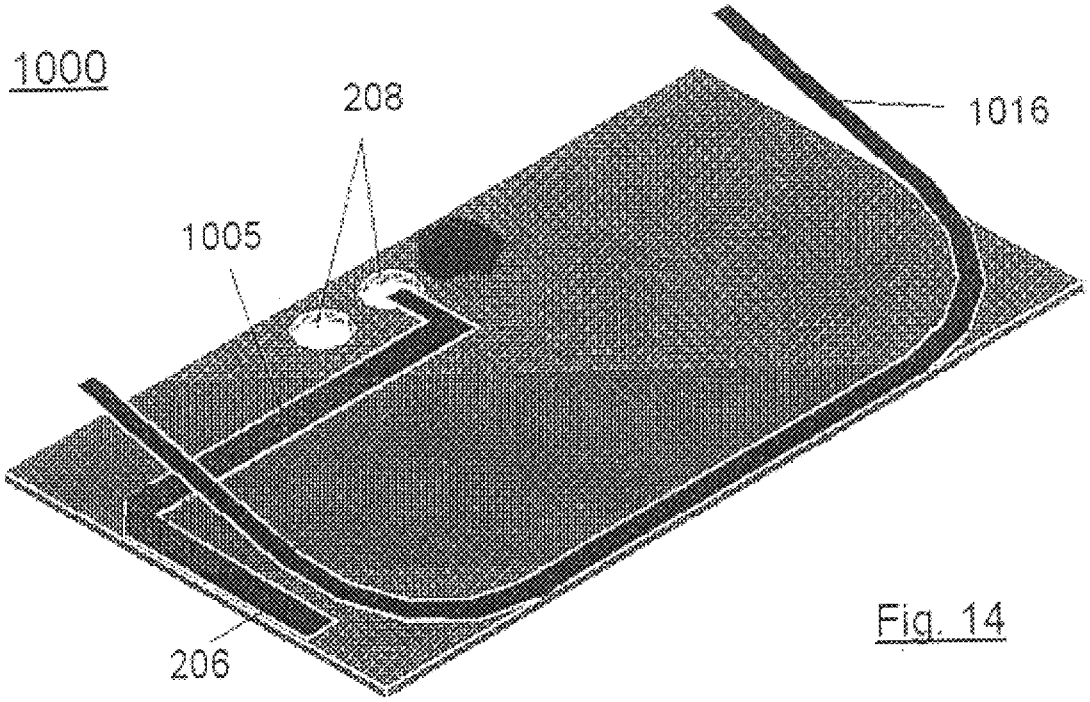
FIG. 14 illustrates a construction similar to that of FIG. 13 but for a single feed line.

FIG. 14 illustrates an antenna 1000 of a similar construction as antenna 900 in FIGS. 13*a* and 13*b,* also including a stub reflector 1016, except here there in a single non-symmetrical feed line 1005, similar to feed line 205 in FIG. 5, instead of a dual symmetrical feed line.

Figure 15A:
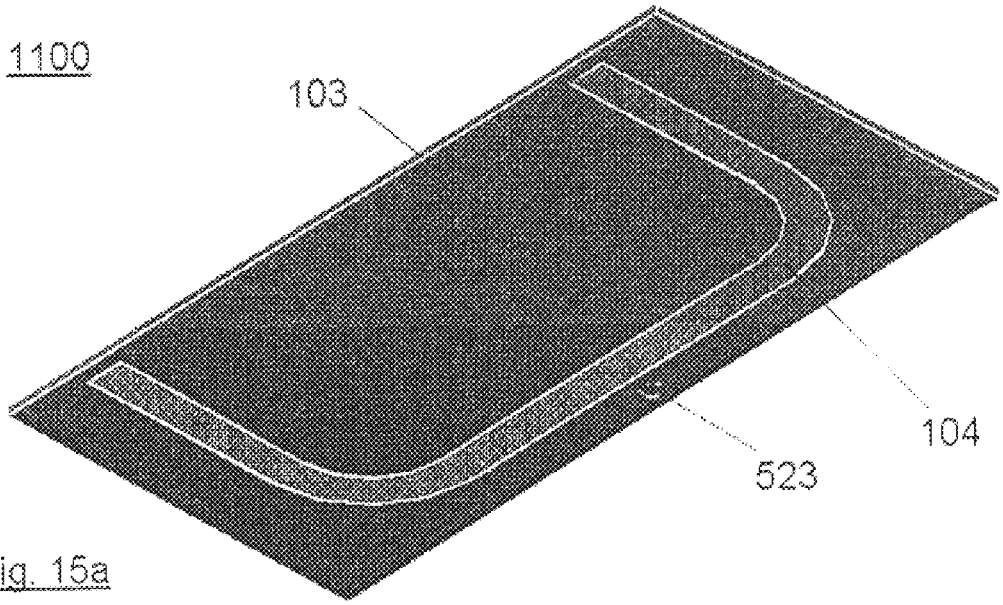
FIGS. 15*a* and 15*b* illustrate two sides of another antenna similar to that of FIG. 8 on a single rigid PCB.
Figure 15B:
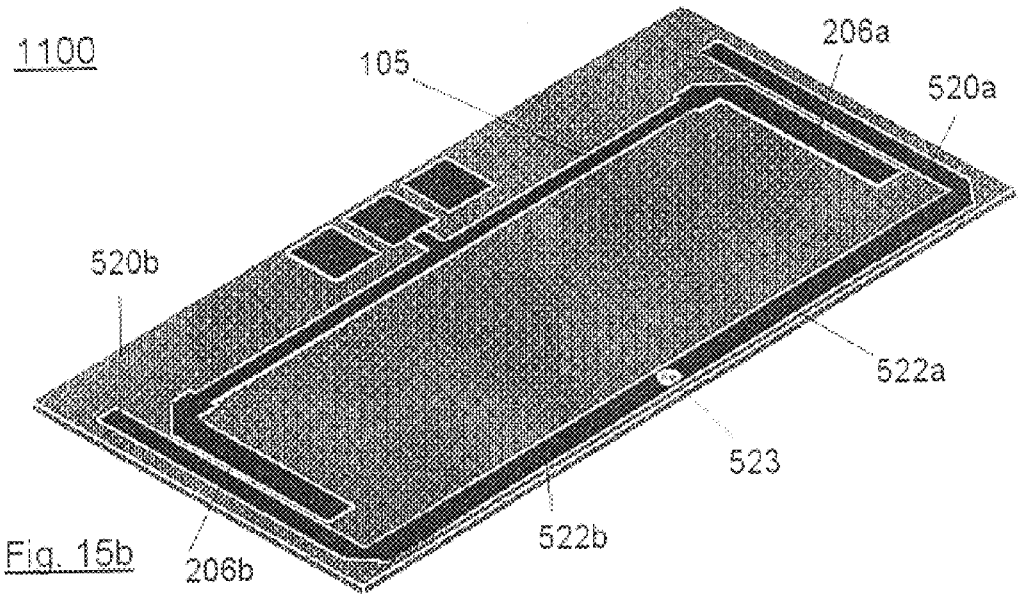

FIGS. 15*a* and 15*b* illustrate the opposite faces of a single-PCB antenna 1100 shown in FIGS. 8*a,* 8*b,* 8*c,* except for the interruptions in the ground plane, and its part are correspondingly numbered to facilitate understanding.

Figure 16:
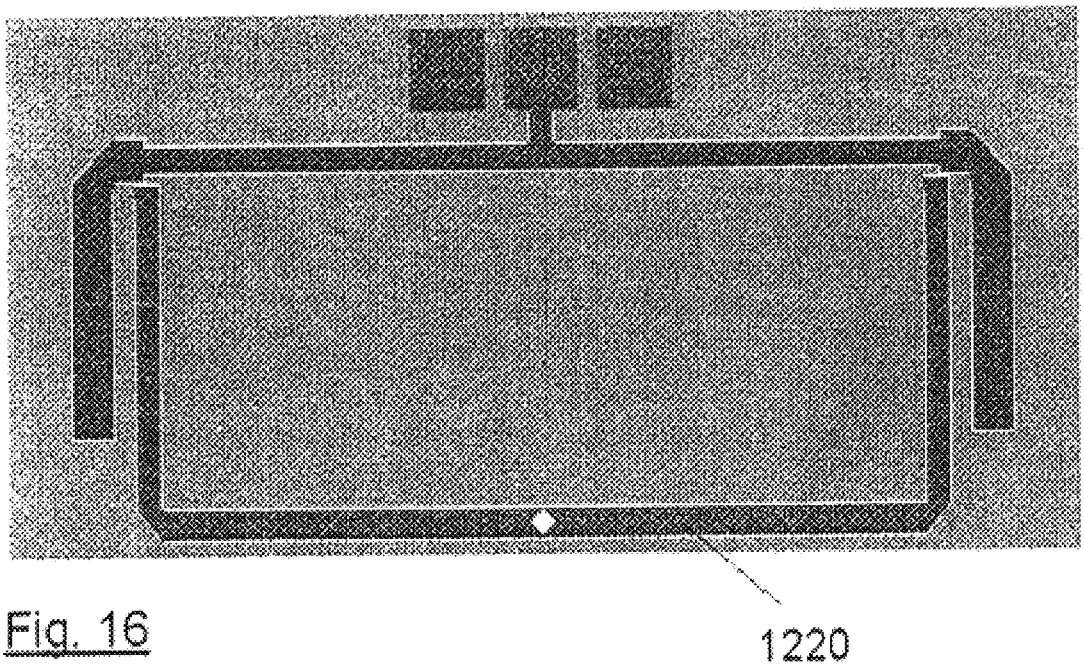
FIG. 16 illustrates a further antenna constructed in accordance with the present invention on a single PCB.

FIG. 16 illustrates an antenna, generally designated 1200, similar to antenna 1100 of FIG. 8, except that here the stub reflectors, therein designated 1220, are inwardly of the reactive load sides of the feed line.

Figures 17, 17A, 17B, 17C:
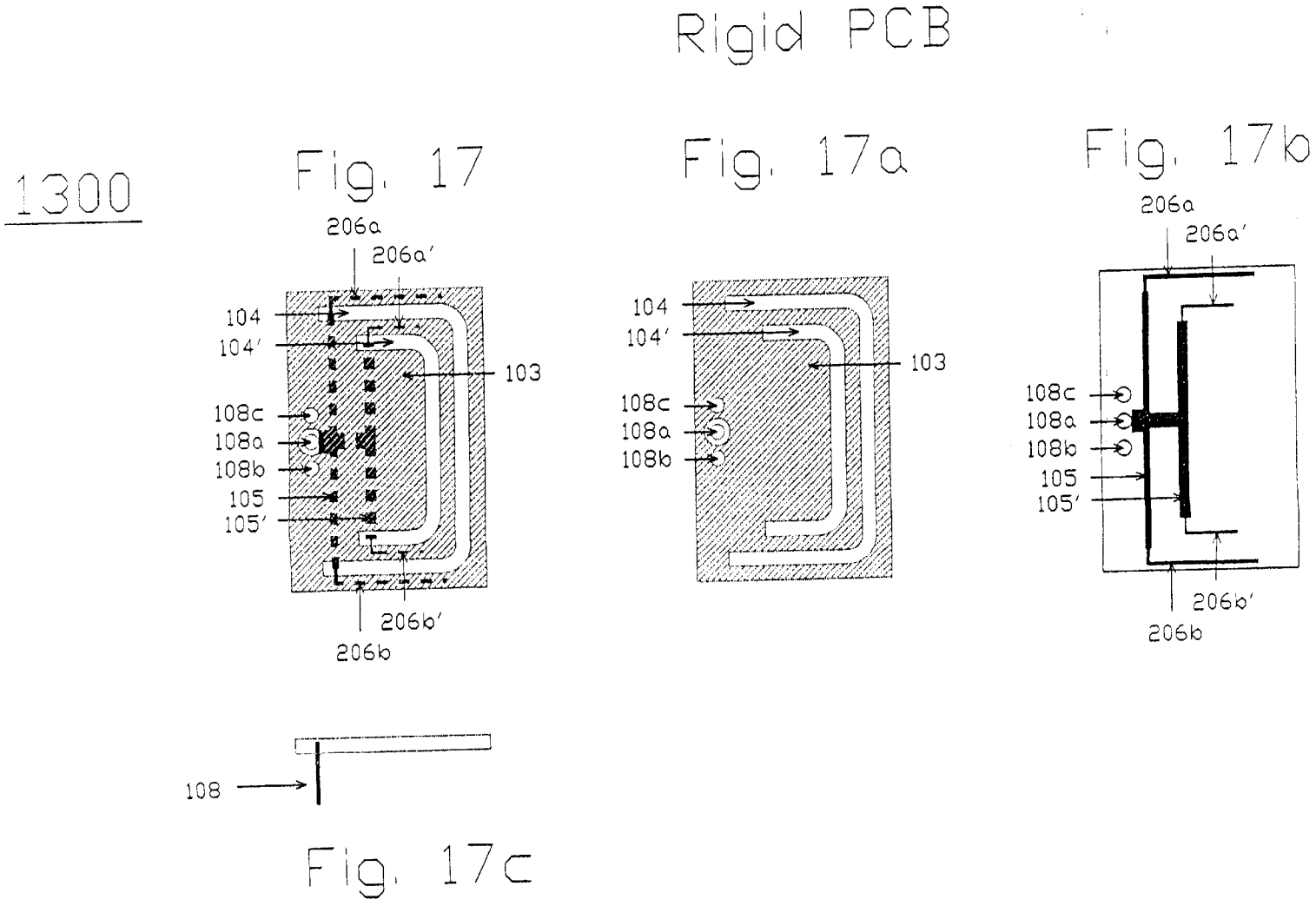
FIGS. 17 and 17*a*–17*c* illustrate an internal antenna constructed in accordance with the present invention on a single PCB having two slots fed by two feed lines.

FIG. 17 illustrates an antenna, generally designated 1300, wherein the antenna is constructed on a single, rigid PCB panel, having an upper face as shown in FIG. 17*a* and a lower face as shown in FIG. 17*b*. The two slots, 104 and 104', cut in the ground plane 103, have a dual feed and a symmetrical construction. Feed line 105 and its reactive loads 206*a* and 206*b* symmetrically excite slot 104. Feed line 105' with its reactive loads 206*a'* and 206*b'* does the same to slot 104'. The combined impedances of each slot with its reactive loads and its feed line are parallel summed to the input pins 108. Although the design shown here is totally symmetric, the slots 104 and 104', the feed lines 105 and 105', the reactive loads 206 and 206' and the excitation point of each one of them can be asymmetrical.

FIG. 17*c* shows a side view of design 1300, wherein the upper and lower side of the antenna can alter.

FIG. 18 illustrates an antenna, generally designated 1400, similar to design 1300 apart from the fact that the slots 104 and 104' cut in the ground plane 103 have a single feed point and one feed line 105. Thus they have a single reactive load for them both. The impedances here are summed in series. Slots 104 and 104' have a symmetrical structure but this in not essential. FIG. 18*a* illustrates the upper side, and FIG. 18*b* the lower side while FIG. 18*c* is a side view.

Figures 19, 19A, 19B, 19C:
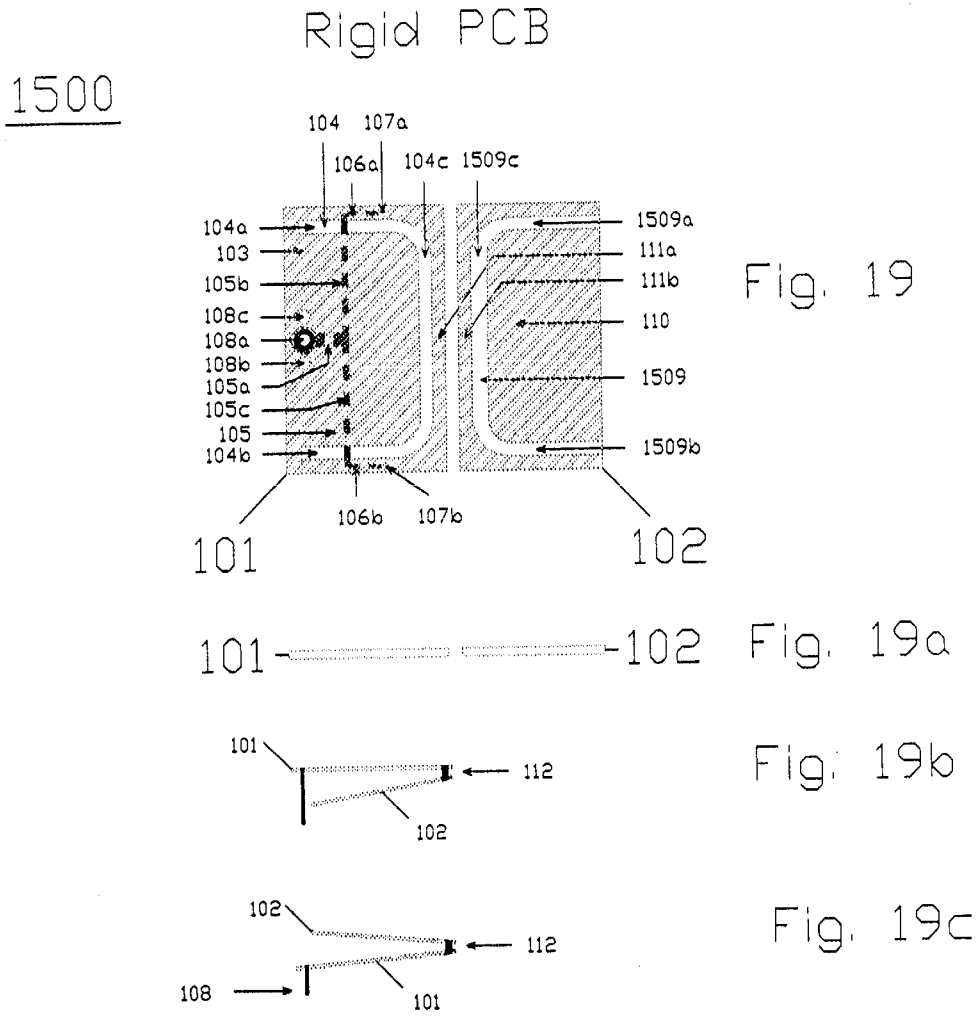
FIG. 19 illustrates an antenna similar to FIG. 3 but with an open slot in the reflector.
FIG. 19*a* being a side view and FIGS. 19*b* and 19*c* showing the assembly.

FIG. 19 illustrates an antenna, generally designated 1500, similar to antenna 100 in FIG. 3 apart from the fact that the slot 1509 cut in the ground continuation 110 of panel 102 is open ended at both sides. Thus both identical and parallel side arms 1509*a* and 1509*b* connected by the bridge 1509*c* are open at one end. The side arms 1509*a* and 1509*b* can be different from each other to have an asymmetrical construction.

While the invention has been described with respect to several preferred embodiments, it will be appreciated that these are set forth merely for purposes of example, and that many variations of the invention may be made. For example, any of the described antenna constructions may include any of the described feeding pins, and at any angle with respect to the main PCB. Conductive paths from one side of a substrate to the opposite side may be by conductor pins, plated-through-holes (PTH), or both. The number of signal feeding pins may vary according to the particular application; for example, in some applications it may be desirable to have one signal pin and a circular array of ground pins (e.g., four), to simulate a coax feed.

Many other variations, modifications and applications of the invention will be obvious to those skilled in the art.

What is claimed is:

1. A multi-band antenna which is resonant and radiant at a high frequency band and at least one lower frequency band, comprising:

a dielectric substrate having opposed faces;

an electrically-conductive layer serving as a ground plane on one face of the dielectric substrate;

an electrically conductive feed line carried on the opposite face of the dielectric substrate, said feed line having at least one feed end and at least one load end;

a slot formed in said ground plane having a feed side and a load side with respect to said feed end and load end, said slot being electromagnetically coupled to said feed line such that said slot is resonant and radiant at said high frequency band;

and a further electrical conductor electrically connected to said ground plane to serve as a continuation thereof at the load side of said slot, said further electrical conductor being dimensioned, located and electromagnetically coupled to said slot at said lower frequency band such as to cause said slot to be resonant and radiant also at said at least one lower frequency band.

2. The antenna according to claim 1, wherein said further electrical conductor serving as a continuation of the ground plane is also in the form of an electrically-conductive layer and also acts as a reflector.

3. The antenna according to claim 2, wherein said latter electrically-conductive layer is continuous and unslotted.

4. The antenna according to claim 2, wherein said latter electrically-conductive layer is formed with a slot closed at both ends.

5. The antenna according to claim 2, wherein said latter electrically-conductive layer is formed with a slot open at at least one end.

6. The antenna according to claim 1, wherein said further electrical conductor serving as a continuation of the ground plane is a conductor shaped to define at least one stub reflector.

7. The antenna according to claim 6, wherein said ground plane is interrupted at the side thereof in alignment with said stub reflector.

8. The antenna according to claim 1, wherein said further electrical conductor serving as a continuation of the ground plane is shaped to define two stub reflectors each electrically connected to said ground plane by a reflector feed.

9. The antenna according to claim 1, wherein said further electrical conductor serving as a continuation of the ground plane is carried on a second dielectric substrate secured at an angle to said dielectric substrate of the ground plane, to form an assembly in which the two electrically-conductive layers are electrically connected together.

10. The antenna according to claim 1, wherein said dielectric substrate is flexible; is formed on one portion with said ground plane, feed line and slot, and on another portion with said further electrical conductor serving as a configuration of the ground plane; and is folded at a predetermined angle with the two electrically-conductive layers connected together.

11. The antenna according to claim 1, wherein said further electrical conductor serving as a continuation of the ground plane is carried on the same dielectric substrate as said ground plane.

12. The antenna according to claim 11, wherein said further electrical conductor serving as a continuation of the ground plane is carried on the same face of said dielectric substrate as said feed line but is insulated therefrom.

13. The antenna according to claim 11, wherein said further electrical conductor serving as a continuation of the ground plane is in the form of stub reflectors.

14. The antenna according to claim 1, wherein said slot in the ground plane is curved.

15. The antenna according to claim 1, wherein said feed line includes at least a pair of feed ends and a power divider which divides the power between said pair of feed ends.

16. The antenna according to claim 1, wherein each feed end includes a change in dimension to match the impedance of the respective part of the slot at the feed side of the slot.

17. The antenna according to claim 1, wherein each load end includes a change in dimension to match the impedance of the respective part of the slot to the load side of the slot.

18. The antenna according to claim 1, wherein each load end of the feed line includes a reactive load.

19. The antenna according to claim 1, wherein said slot in the ground plane is closed at both ends.

20. The antenna according to claim 1, wherein slot in the ground plane is open at least at one end.

21. The antenna according to claim 1, wherein said ground plane is formed with two curved slots electromagnetically coupled to said feed line.

22. The antenna according to claim 1, wherein said ground plane is formed with two curved slots, and said dielectric substrate includes two feed lines electromagnetically coupled to said two curved slots.

23. A microwave antenna resonant and radiant at a wide operational bandwidth, comprising:

a dielectric substrate having opposed faces;

an electrically-conductive layer serving as a ground plane on one face of the dielectric substrate;

an electrically conductive feed line carried on the opposite face of the dielectric substrate, said feed line having at least one feed end and at least one load end;

and a curved slot formed in said ground plane having a feed side and a load side with respect to said feed end and load end, said slot being electromagnetically coupled to said feed line, such that said slot is resonant and radiant at said wide operation bandwidth;

said feed line including a change in width at least at one of said ends thereof to match the impedance of the antenna for said wide operational bandwidth.

24. The antenna according to claim 23, wherein said curved slot is substantially of a U-configuration, including two side arms joined by a bridge.

25. The antenna according to claim 23, wherein said feed line includes at least a pair of feed ends and a power divider which divides the power between said pair of feed ends.

26. The antenna according to claim 25, wherein said feed line includes a tuning stub to match the input impedance of said slot.

27. The antenna according to claim 25, wherein said pair of feed ends of the feed line are symmetrically coupled to said curved slot.

28. The antenna according to claim 23, wherein said at least one feed end includes a change in width to match the impedance of the respective part of the slot at the feed side of the slot.

29. The antenna according to claim 23, wherein said at least one load end includes a change in width to match the impedance of the respective part of the slot to the load side of the slot.

30. The antenna according to claim 23, wherein each load end of the feed line includes a reactive load.

31. The antenna according to claim 23, wherein said curved slot in the ground plane is closed at both ends.

32. The antenna according to claim 23, wherein said curved slot in the ground plane is open at at least one end.

33. The antenna according to claim 23, wherein said antenna includes a further electrical conductor electrically connected to said ground plane to serve as a continuation thereof at the load side of said slot and electromagnetically coupled to said slot at least at one lower frequency band such as to cause said slot also to be resonant and radiant at said lower frequency.

34. The antenna according to claim 33, wherein said further electrical conductor serving as a continuation of the ground plane is also in the form of an electrically-conductive layer and also acts as a reflector.

35. The antenna according to claim 34, wherein said latter electrically-conductive layer is continuous and unslotted.

36. The antenna according to claim 34, wherein said latter electrically-conductive layer is also formed with a slot.

37. The antenna according to claim 33, wherein said further electrical conductor serving as a continuation of the ground plane is a shape to define at least one stub reflector.

38. The antenna according to claim 37, wherein said ground plane is interrupted at the side thereof in alignment with said stub reflector.

39. The antenna according to claim 33, wherein said further electrical conductor serving as a continuation of the ground plane is carried on a second dielectric substrate secured at an angle to said dielectric substrate of the ground plane, to form an assembly in which the two electrically-conductive layers are electrically connected together.

40. The antenna according to claim 33, wherein said further electrical conductor serving as a continuation of the ground plane is carried on the face of said dielectric substrate carrying said feed line but electrically insulated therefrom.

41. The antenna according to claim 23, wherein said ground plane is formed with two curved slots electromagnetically coupled to said feed line.

42. The antenna according to claim 23, wherein said ground plane is formed with two curved slots, and said dielectric substrate includes two feed lines electromagnetically coupled to said two curved slots.

43. An antenna which is resonant and radiant at a predetermined frequency band, comprising:

an electrically-conductive ground plane of the antenna;

an electrical conductor electrically connected to said ground plane of the antenna to serve as a continuation thereof, said electrical conductor being dimensioned, located and electromagnetically coupled to said antenna such as to enhance the operation thereof at said predetermined frequency band;

an electrically conductive feed line having at least one feed end and at least one load end;

and a slot formed in said ground plane having a feed side and a load side with respect to said feed end and load end, said slot being electromagnetically coupled to said feed line such that said slot is resonant and radiant also at a lower frequency band than side predetermined frequency band.

44. The antenna according to claim 43, wherein said electrical conductor serving as a continuation of the ground plane is in the form of an electrically-conductive layer and also acts as a reflector.

* * * * *